US005927338A

United States Patent [19]

Boticki et al.

[11] Patent Number: 5,927,338

[45] Date of Patent: Jul. 27, 1999

[54] MIXING EDUCTOR

[75] Inventors: John A. Boticki; James L. Bournoville, both of Racine; James H. Lohr, Union Grove; Richard E. Rakoczy, Franklin; Charles E. Seaman, Jr., Kenosha, all of Wis.

[73] Assignee: S.C. Johnson Commercial Markets, Inc., Sturtevant, Wis.

[21] Appl. No.: 08/803,488

[22] Filed: Feb. 20, 1997

Related U.S. Application Data

[63] Continuation-in-part of application No. 08/634,639, Apr. 18, 1996, abandoned.

[51] Int. Cl.[6] ..... E03B 5/00

[52] U.S. Cl. ..... 137/888; 417/76; 138/41; 138/40; 137/889; 137/895; 137/897; 137/599.1

[58] Field of Search ..... 137/599.1, 888, 137/895, 889, 897; 417/76; 138/40, 41, 42

[56] References Cited

U.S. PATENT DOCUMENTS

| | | | |
|---|---|---|---|
| 1,245,898 | 11/1917 | Gates | 138/40 |
| 1,790,854 | 2/1931 | Defrance | 138/40 |
| 1,954,105 | 4/1934 | Stoddard | 299/83 |
| 2,164,153 | 6/1939 | Friedrich | 137/599.1 |
| 2,507,410 | 5/1950 | Kemp | 137/599.1 |
| 2,965,268 | 12/1960 | Bauerlein | 222/193 |
| 3,072,137 | 1/1963 | McDougall | 137/216 |
| 3,158,169 | 11/1964 | Smith | 137/216 |
| 3,166,086 | 1/1965 | Holmes | 137/217 |
| 3,728,129 | 4/1973 | Sargeant | 137/889 |
| 3,863,843 | 2/1975 | Hechler, IV | 239/318 |
| 4,123,800 | 10/1978 | Mazzei | 366/150 |
| 4,142,681 | 3/1979 | Hechler, IV | 239/318 |
| 4,414,998 | 11/1983 | Rudler et al. | 137/216 |
| 4,424,046 | 1/1984 | Hechler, IV | 239/318 |
| 4,538,636 | 9/1985 | Cleland | 137/216 |
| 4,697,610 | 10/1987 | Bricker et al. | 137/3 |
| 4,951,713 | 8/1990 | Jordan | 137/895 |
| 5,159,958 | 11/1992 | Sand | 137/888 |
| 5,253,677 | 10/1993 | Sand | 137/888 |
| 5,518,020 | 5/1996 | Nowicki et al. | 137/216 |
| 5,522,419 | 6/1996 | Sand | 137/216 |
| 5,544,810 | 8/1996 | Horvath, Jr. et al. . | |

FOREIGN PATENT DOCUMENTS

| | | |
|---|---|---|
| WO91/16138 | 10/1991 | WIPO . |
| WO95/34778 | 12/1995 | WIPO . |

*Primary Examiner*—Denise L. Ferensic
*Assistant Examiner*—Ramyar Farid
*Attorney, Agent, or Firm*—Renee J. Rymarz

[57] ABSTRACT

Disclosed is an improved mixing eductor (10) of the type wherein the primary liquid (17), e.g., water, is in a main stream (201) flowing in a downstream direction. A venturi tube (51) is in the eductor (10) and has an annular sharp edge (131) in the main stream (201), thereby dividing such stream (201) into a primary stream (179) and a secondary stream (181) around the primary stream (179). The eductor (10) has an air gap (103) and a flow guide (47) downstream thereof. In a specific embodiment, the flow guide (47) is annular around the venturi tube (51) and the tube (51) and the guide (47) are in spaced telescoped relationship. Several embodiments of the eductor (10) and a new method for mixing liquids are disclosed.

23 Claims, 16 Drawing Sheets

FIG. 18
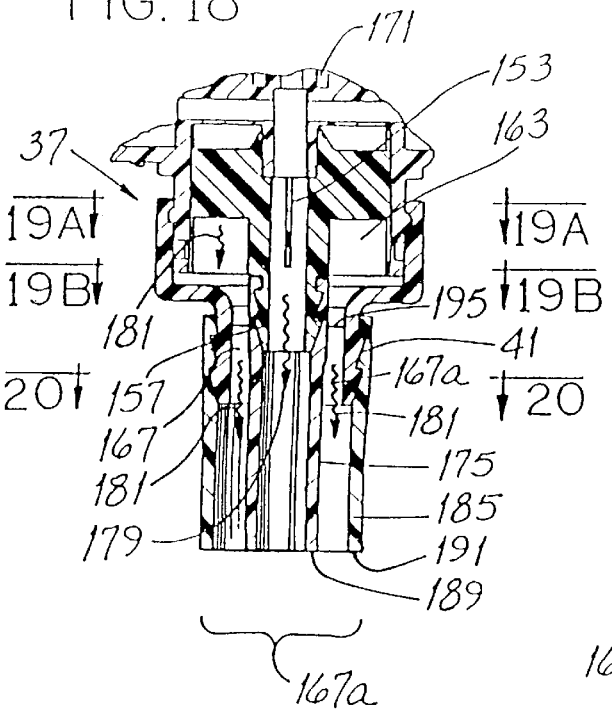
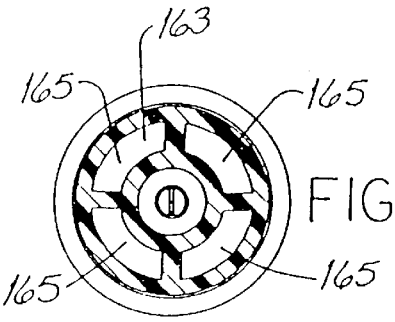
FIG.19A
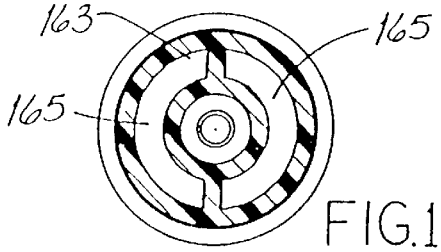
FIG.19B
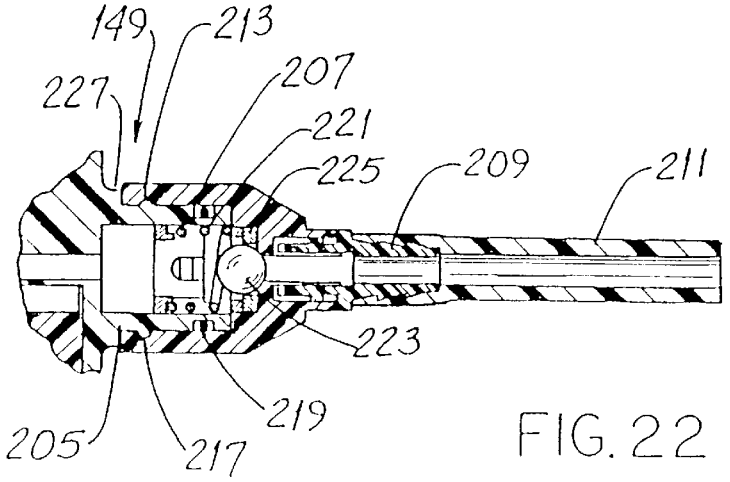
FIG. 22

MIXING EDUCTOR

RELATED APPLICATION

This application is a continuation-in-part of application Ser. No. 08/634,639 filed on Apr. 18, 1996, and now abandoned.

TECHNICAL FIELD OF THE INVENTION

This invention relates generally to fluid handling and, more particularly, to combining liquids by aspiration using an eductor having one or more inlets and a single outlet.

BACKGROUND ART

Venturi-type mixing devices, often known as eductors, use a principle discovered by Daniel Bernoulli (1700–1782) and are used for applications involving mixing of two liquids. In general, an eductor uses a stream of first liquid flowing from a (usually) pressurized source to a primary inlet thence through a venturi. A second inlet passage extends between the venturi and a container holding a second liquid to be mixed with the first. Often the first liquid is water and the second liquid is a chemical product.

As but one example of how eductors are used to mix water and chemical products, members of building custodial staff often use dispensing equipment which contains one or more different liquids in concentrated form. Such concentrated liquids are in separate containers in the equipment or connected to such equipment. The equipment includes eductor (s) to mix water and a concentrated liquid to form a dilute solution, e.g., a cleaning liquid.

The difference in pressure between that of the concentrate container and that in the eductor venturi urges the second liquid into the path of the high-velocity primary liquid and the liquids are thereby mixed. The resulting dilute solution is directed to a vessel, e.g., a pail used by custodial staff for cleaning. Merely as examples, concentrated liquids may include a neutral cleaner, a "spray-and-wipe" cleaner/degreaser and a glass cleaner.

A manufacturer of dispensing equipment (sold under the trademark SOLUTIONS CENTER® and other trademarks) and liquid concentrates used therewith is S.C. Johnson & Son, Inc. of Racine, Wis., the assignee of the invention. An eductor of the type used in SOLUTIONS CENTER® equipment is described in U.S. Pat. No. 5,544,810 (Horvath, Jr. et al.) which is incorporated herein by reference.

Examples of eductor-type mixing devices are disclosed in U.S. Pat. Nos. 3,072,137 (McDougall); 3,166,086 (Holmes); 4,697,610 (Bricker et al.); 5,159,958 (Sand): 5,253,677 (Sand); 5,529,241 (Horvath, Jr. et al.), in PCT International Application Publication No. WO95/34778 (Nowicki et al.) and in other patent documents. The proportioner of the Bricker et al. patent divides the incoming liquid stream into two flow paths, i.e., a primary path through the venturi and a secondary path through two parallel passages. Such passages diverge in a downward direction and liquid flowing therethrough is combined in a cylindrical region with the solution flowing out of the venturi.

The Nowicki et al. PCT application involves a proportioner similar to that of the Bricker et al. patent. Such proportioner has a venturi system, the upper venturi nozzle of which includes three tapered flats rather than the opposed flat sides used in the Bricker et al. proportioner.

The eductor of the Sand '958 patent has passages parallel to the venturi. Water which splashes away from the eductor nozzle and is deflected by the splash plate runs down such passages and past the venturi to be joined with the solution flowing from such venturi. The parallel passages radially outward from the venturi in the eductor of the Sand '677 patent perform a similar "splash-draining" function.

While the devices of these and other prior art patents have been generally satisfactory for their intended purposes, they are not without some disadvantages. One disadvantage involves the matter of mixture foaming. If the dilute solution is excessively foamed, the vessel receiving such solution may overflow with foam and yet contain only a modest quantity of liquid solution.

While not wishing to subscribe to any particular theory as to why certain prior art devices cause excessive foaming, it is believed that aeration of the primary liquid stream may be a significant factor. Another factor may involve joining liquids flowing along two flow paths at high velocity.

Considering the Bricker et al. patent, it is noted that the volume of water flowing down the diverging parallel passages forming the secondary path and/or the above-mentioned cylindrical region may be insufficient to "seal" against the passage walls and prevent air entry. Aeration may result.

Considering the eductor of the Sand '958 patent, the quantity of liquid flowing through the splash-draining passages is unlikely to fill the entirety of the open area below such passages. This may also encourage aeration. And the eductor of the Sand '958 patent flows the primary liquid stream through a disc plate having an enlarged orifice. The resulting space between such stream and the orifice may promote aeration.

The eductor of the Sand '958 patent seemingly has yet other disadvantages. The diameter of the orifice in the disc base is very significantly greater (about 3.5 to 4 times greater) than the diameter of the outlet orifice in the conical portion. To put it another way, the area of the orifice in the disc base is about 12–14 times greater than the area of the outlet orifice. Such outlet orifice seemingly cannot accept any but a very modest flow rate from such disc base orifice. At other than modest flow rates, this configuration apparently causes a good deal of backwardly-directed splashing and is believed to dictate the need to provide a spray shield to at least help prevent spray from exiting the air gap slots.

Yet another disadvantage of certain prior art eductors is that they have inadequate "back pressure tolerance." This is another way of saying that such eductors exhibit undesirably-high pressure drop along their length. (Such pressure drop is sometimes referred to as "insertion loss.")

Such pressure drop can be of concern for the following reasons. Assuming the primary liquid enters the eductor at some maximum pressure, excessive eductor pressure drop results in less pressure available for liquid mixing and, notably, for urging the mixed solution from the eductor outlet. The latter consideration is always important and becomes more so if, for example, a hose connected to the outlet of an eductor is elevated above the eductor or is even pointed upward while mixed liquid is flowing therefrom. Such hose positioning increases back pressure at the eductor outlet. And using an improperly-sized hose and/or a hose of inordinate length also increases eductor outlet back pressure, leaving less pressure available for solution dispensing.

It is noted that the conical opening and converging nozzle mentioned in the Sand '958 and '677 patents, respectively, present relatively long flow passages to a stream of water passing through such passages. And long flow passages impose higher pressure drops, leaving less pressure available for the mixing and dispensing functions.

Another shortcoming of certain prior art eductors is that they are capable of mixing only two liquids. There are instances involving, e.g., dispensing equipment where it would be highly desirable to mix more than two liquids and/or to perform other functions not possible with two inlet eductors.

Yet another shortcoming of certain prior art eductors is that it is difficult to change a performance characteristic, e.g., the level of vacuum "pulled" by the eductor.

Still another characteristic of certain eductors is that they must be oriented vertically. But sometimes vertical orientation is not practical or even possible.

And yet another characteristic of certain prior art eductors is that they are somewhat noisy and operate with a very-audible and characteristic "hissing" sound.

A new mixing eductor which overcomes some of the problems and shortcomings of known eductors would be an important advance in the art.

DISCLOSURE OF THE INVENTION

It is an object of the invention to provide an improved mixing eductor overcoming some of the problems and shortcomings of the prior art.

Another object of the invention is to provide an improved mixing eductor of the type having an air gap providing protection in event of flow interruption.

Another object of the invention is to provide a mixing eductor which is particularly well adapted for use in cleaning solution dispensing equipment.

Another object of the invention is to provide a mixing eductor which significantly reduces foaming.

Yet another object of the invention is to provide a mixing eductor which significantly reduces aeration.

Another object of the invention is to provide a mixing eductor which has relatively-low insertion loss and relatively-high back pressure tolerance.

Another object of the invention is to provide a mixing eductor which, in certain embodiments, is capable of mixing any one, some or all of at least three liquids, e.g., concentrates, with water or another liquid.

Still another object of the invention is to provide a mixing eductor which, in use, is not restricted to vertical mounting.

Another object of the invention is to provide a mixing eductor which substantially eliminates "back-spraying."

Another object of the invention is to provide a mixing eductor, a performance characteristic of which can be changed by changing one part, i.e., an easy-to-mount flooding tube.

Another object of the invention is to provide a mixing eductor which reduces eductor noise.

Another object of the invention is to provide a mixing eductor which dramatically reduces or substantially eliminates annoying "backflooding" through the air gap even though an eductor output hose is pointed upward and/or is at an elevation above the eductor. How these and other objects are accomplished will become apparent from the following descriptions and from the drawings.

In general, the invention involves an eductor of the type used for mixing first and second liquids, e.g., water and a concentrated cleaning liquid, respectively. The first liquid is in a main stream flowing in a downstream direction. The improvement comprises a tube (e.g., a venturi tube) having an annular sharp edge in the main stream, thereby dividing the main stream into a primary stream and an annular secondary stream around the primary stream and spaced radially outward from such primary stream.

The "laminarity" of the main stream (and, thus, at least of the primary stream) is enhanced by an apparatus for "smoothing" turbulent liquid entering the eductor inlet. Such apparatus may be embodied as a plurality of spaced screens (vertically aligned with one another or angled to one another) or may be embodied as a body having a plurality of downwardly-converging or funnel-shaped passages formed therein. The passages are sized, shaped and located so that each passage "breaks into" one or more adjacent passages and "upstream-pointing" sharp edges are thereby formed.

In another aspect of the invention, the tube includes an interior surface forming a conduit converging in a downstream direction. The tube also has an outward surface diverging in a downstream direction and the exterior shape of such surface (and the tube sharp edge) generally define a cone truncated at a plane normal to its center axis. More specifically, the sharp edge (which may be said to be "knife-like") is defined by the intersection of the interior surface and the outward surface.

In yet another aspect of the invention, the eductor has an air gap, a supply nozzle upstream of the air gap and a flow guide downstream of the air gap. The flow guide is annular around the tube. The tube and the guide are in spaced telescoped relationship and define an annular space between them. The secondary stream fills the space and thereby provides what may be termed a seal preventing air from passing through the space. It is believed that the afore-described seal feature is responsible, at least in part, for the back pressure tolerance and for the aeration-reducing performance of the new eductor.

In more specific aspects of the flow guide and the tube/guide relationship, the guide has a first portion converging in a downstream direction at a first angle and a second portion extending from the first portion and converging in a downstream direction at a second angle. In a specific embodiment, the shape of the flow guide resembles that of a funnel in that the second angle is less than the first angle.

The supply nozzle is significant to the excellent operating characteristics of the new eductor. Such nozzle has a substantially knife-edged or sharp-edged opening characterized by a ratio of the diameter of the opening to the axial length of such opening of between about 15:1 and about 25:1. In a specific embodiment, the axial length of the opening is no more than about 0.010 inches (0.25 mm) and the diameter is about 0.200 inches (5.1 mm). The foregoing configuration of the supply nozzle helps minimize resistance to liquid flow.

And the new eductor has yet other noteworthy features. The eductor has an output section with a deceleration chamber that reduces the velocity of the secondary stream and thereby tends to "quiet" such stream. There is also a combining zone downstream of the deceleration chamber where the secondary stream and the primary stream (the latter then including, e.g., a cleaning concentrate) are combined together to form a solution mixed in the desired ratio. The cross-sectional area of the combining zone is less than, and preferably substantially less than, the chamber cross-sectional area. (The combining zone may be in the eductor or, in certain combinations involving the eductor, in tubing downstream of the eductor.)

Known eductors mix water and one other liquid. A feature of the inventive eductor is that it may be configured for mixing either or both of two other liquids with water. Such eductor has a plurality of channels in flow communication with the tube. Liquids other than water, e.g., cleaning concentrates, can be mixed by flowing a different concentrate along each channel.

In the new eductor, the primary stream flowing through the tube is extremely laminar and has substantially no entrained air other than any small amount of air in the water coming into the eductor. Therefore, the primary stream may not intimately contact the cylindrical wall downstream and air could enter the tube and impair venturi action. To spread the primary stream and help assure that it contacts such cylindrical wall to form a good seal, the eductor has a "panel-like" reed member. Such reed member is rectangular, axially-disposed, positioned in the primary stream like a baffle and extends parallel to the cylindrical wall.

And there are yet other aspects of the invention. In a highly preferred eductor (which one might refer to as an "upright funnel" version), the flow guide (which resembles an upright funnel) is above the venturi sharp edge and has a guide opening through which liquid is directed toward the sharp edge. The sharp edge has an edge diameter and the guide opening has a guide opening diameter greater than the edge diameter.

Such flow guide includes a guide passage converging toward the guide opening. The passage defines an angle of convergence between about 5° and about 15°. Most preferably, such angle is about 10°.

And there is a wide-mouth collector passage converging toward the guide passage. The collector passage defines an angle of convergence between about 40° and about 80° and most preferably, such angle is about 60°.

In another embodiment (which one might refer to as an "inverted funnel" version), the guide opening is an input opening to the flow guide (which resembles an inverted funnel) and such flow guide has a guide passage below the guide opening and converging toward the venturi sharp edge. A preferred angle of convergence is between about 5° and about 15°. Most preferably, such angle is about 10°.

The flow guide further includes a bypass guide portion in telescoped relationship to the venturi tube. Such bypass guide portion diverges toward the eductor outlet section.

In yet another embodiment (a "standpipe" version), the flow guide resembles a standpipe and includes a guide passage below the guide opening. Such guide passage is substantially cylindrical. There is also a bypass guide portion around the venturi tube and converging toward the region of low pressure in such tube.

Another feature of the new eductor may be used with several embodiments. The eductor has a support device below the venturi tube and a flooding tube is attached to the device by "snap-fit" and has a passage therethrough. There is a flooding pin extending across the passage.

The eductor may be put up in kit form having first and second flooding tubes, each having an inlet end, respective first and second passages and respective first and second pins. The pins are spaced below (downstream of) the inlet end by a dimension.

In one version, the pins are of differing diameter and in another version, the pins are of the same diameter and are spaced below the inlet ends of their respective flooding tubes by differing dimensions. After appreciating the specification, one of ordinary skill will recognize that each flooding tube may have a pin diameter and pin spacing from tube inlet end, both of which differ from the diameter and spacing of the other tube.

In a highly preferred eductor, the venturi tube has an annular sharp edge as noted above. As described elsewhere in this specification, a person may thrust a finger into the eductor air gap and, perhaps, touch and damage the tube edge. Therefore, an embodiment of the new eductor has a nozzle protector interposed between the air gap and the venturi tube and providing a barrier preventing inadvertent contact with such tube.

Another embodiment of the new eductor has proven particularly effective in liquid mixing, even with significant back pressure imposed thereon by, e.g., a downstream tube or implement connected to the eductor. The eductor is particularly well suited for foam or broadcast spraying applications and has features which address "backsplashing" through the air gap, a problem characterizing some prior art air gap eductors.

The eductor includes a collector passage in the flow guide, an overflow chamber isolated from the air gap by an imperforate wall and an aperture formed in the flow guide. The aperture extends between and is in flow communication with the collector passage and the overflow chamber and permits a quantity of liquid, e.g., water, to bypass the venturi tube and flow to the outlet port. In other words, if the incoming water feed rate and/or the back pressure imposed on the eductor are sufficient to prevent all incoming water from be accepted by the venturi tube, the aperture provides a bypass path for the excess water.

In a more specific aspect of this embodiment, the aperture is bounded by an edge at the collector passage and such edge defines a first area. The collector passage has a minimum flow area at its lower end and the first area is at least twice the minimum flow area. More preferably, such first area is at least three times the minimum flow area.

In another, more specific aspect, there are first and second apertures formed in the flow guide and extending between the collector passage and the overflow chamber. Each of the apertures has an edge at the collector passage and each of the edges defines a first area. The total of the first areas is at least 1.5 times the minimum flow area and, preferably, is in the range of 1.5 to 2.5 times the minimum flow area.

In a specific embodiment, the first and second apertures are in registry with a lateral axis which is generally normal to the long axis. Stated another way, such apertures are opposite one another in the flow guide.

In another aspect of this embodiment, the flow guide has a lower end spaced from the air gap and the lower end has an interior dimension measured generally normally to the eductor long axis. Each of the apertures is spaced above the lower end by a spacing dimension at least equal to the interior dimension and, preferably, by a spacing dimension which is between 1.0 and 6.0 times the interior dimension.

In yet another aspect of this embodiment, the flow guide includes a lower end and the venturi tube abuts the lower end. In a specific embodiment, the lower end has a pocket formed in it and the venturi tube is in sealing engagement with the pocket.

The venturi tube has an inlet mouth defining a mouth area and the mouth area is at least equal to the minimum flow area of the flow guide. When the minimum flow area and the mouth area are circular, such areas are concentric. Configured in this way, the venturi tube inlet mouth is prevented from having an inwardly projecting lip which may otherwise impede the flow of liquid therethrough.

In still another aspect of this embodiment, the flow guide has a first portion and a second portion which define the collector passage. Each portion has a length measured along the long axis and the length of the second portion is at least equal to the length of the first portion. Most preferably, the length of the second portion is between 1.0 and 4.0 times the length of the first portion.

Other aspects of the invention involve a new method for mixing a first liquid and a second liquid in an eductor. The method includes the steps of flowing a first liquid in a main stream within the eductor and directing the main stream across a sharp edge, thereby dividing the main stream into a primary stream and a secondary stream annular around the primary stream. The second liquid is then introduced into the primary stream.

More specifically, the eductor includes the tube noted above and the aforementioned plural channels in flow communication with the tube. The introducing step includes flowing the second liquid along one of the plural channels into the primary stream.

To mix second or third liquids (e.g., different cleaning concentrates) with the first liquid, e.g., water, the introducing step includes alternately flowing the second liquid along one of the plural channels into the primary stream and flowing the third liquid along another one of the plural channels into the primary stream.

Following the introducing step, other aspects of the method include flowing the secondary stream through the deceleration chamber (thereby reducing the velocity of the secondary stream) and flowing the secondary stream through the combining zone to merge the secondary stream and the primary stream.

Further details of the invention are set forth in the following detailed description and in the drawings.

BRIEF DESCRIPTION OF THE DRAWINGS

FIG. 18 is a sectional elevation view of the eductor generally like the view of FIG. 6. Parts are broken away.

FIG. 19A is a sectional plan view of the eductor taken along the viewing plane 19A—19A of FIG. 18.

FIG. 19B is a sectional plan view of the eductor taken along the viewing plane 19B—19B of FIG. 18.

FIG. 22 is an enlarged sectional elevation view of an eductor input port like that shown in FIG. 6. Parts are broken away.

BEST MODES FOR CARRYING OUT THE INVENTION

Figure 1:
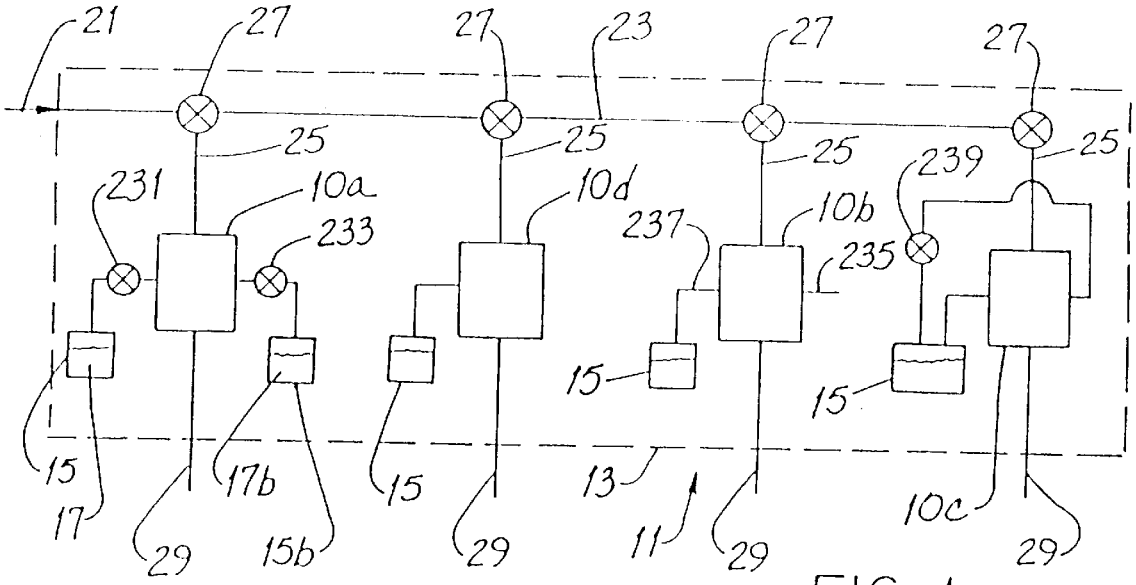
FIG. 1 is a schematic diagram of a type of dispensing equipment with which the new eductor may be used.
Figure 3:
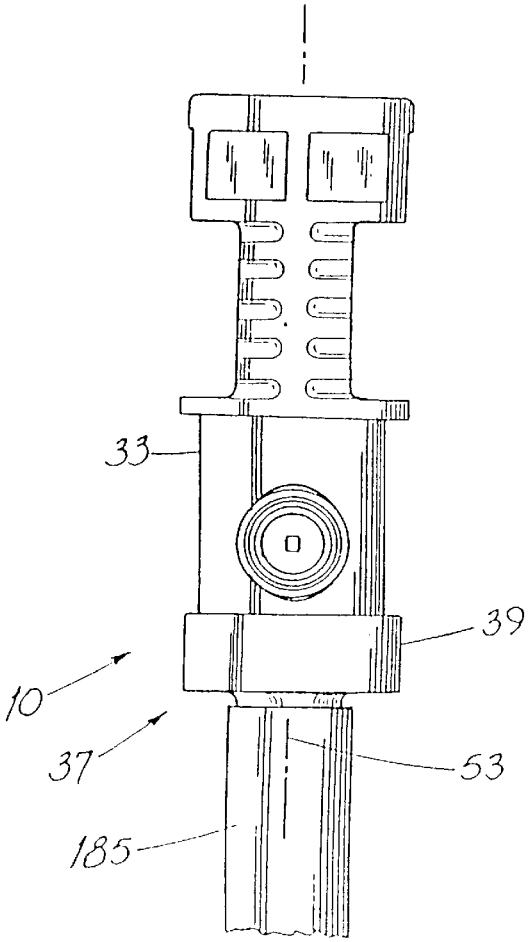
FIG. 3 is an elevation view of the eductor. Parts of hoses attached thereto are broken away.

Before describing the new mixing eductor 10 and related method, it will be helpful to have an understanding of an exemplary application for such eductor 10. FIG. 1 shows a schematic diagram for a type of dispensing equipment 11 having an enclosure 13 and containers 15 in the enclosure 13 or, possibly, outside the enclosure 13 but connected as shown. Normally, each container 15 is filled with a different liquid 17. But as explained below, there may be occasions where it is desirable to have two containers 15 filled with the same liquid 17.

The inlet line 21 of the equipment 11 is connected to a source of water feeding a header 23. Branch pipes 25 are connected to the header 23 and each branch pipe 25 includes a valve 27 "dedicated" to that pipe 25. When a particular valve 27 is actuated, water flows through the related eductor 10*a*, 10*b*, 10*c* or 10*d* and mixes a concentrated liquid 17 with such water to form a dilute solution. Each mixed dilute solution is dispensed through a separate tube 29. Other aspects of the dispensing equipment are described below.

Referring next to FIGS. 2, 3, 4, 5, 6 and 21, components of the new eductor 10 will be described in general. Such description is followed by a more detailed explanation of features of such components.

Figure 6:
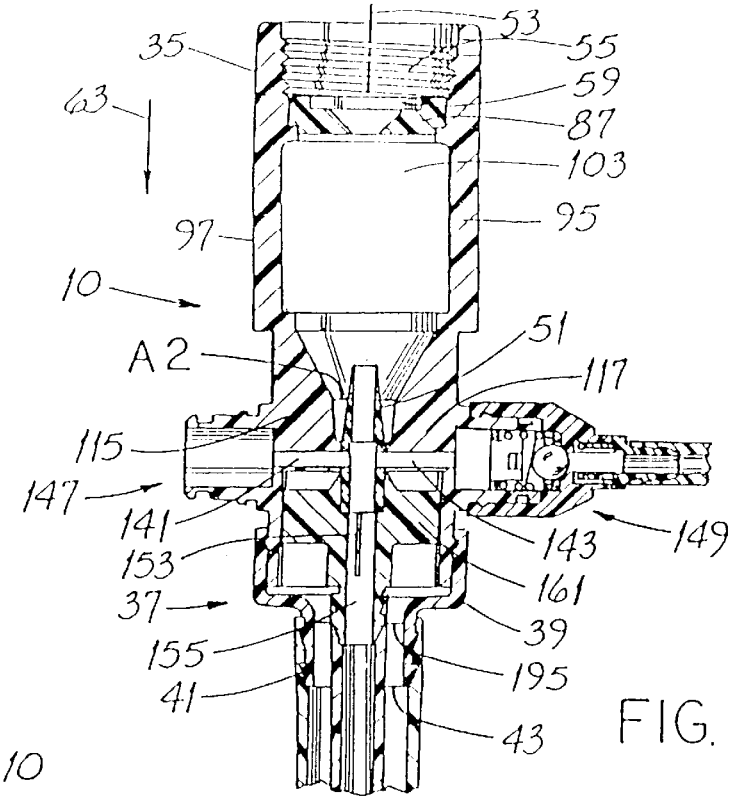
FIG. 6 is a sectional elevation view of the eductor taken along the viewing plane 6—6 of FIG. 4.
Figure 5:
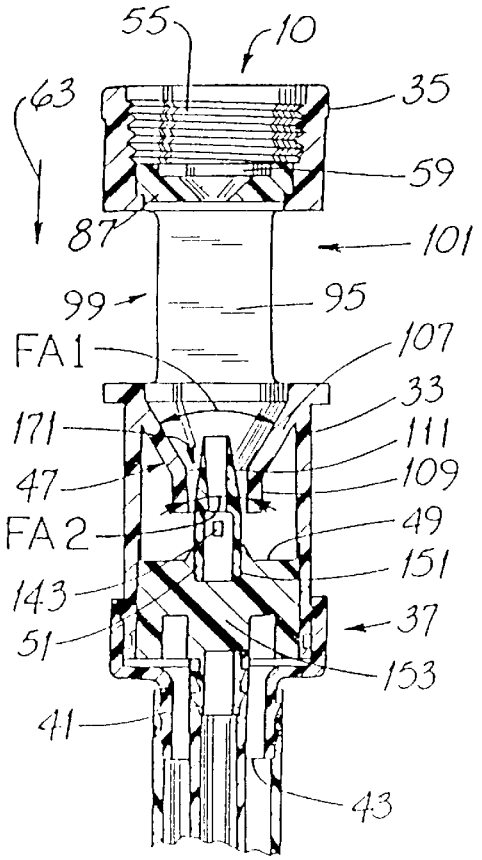
FIG. 5 is a sectional elevation view of the eductor taken along the viewing plane 5—5 of FIG. 4.
Figure 4:
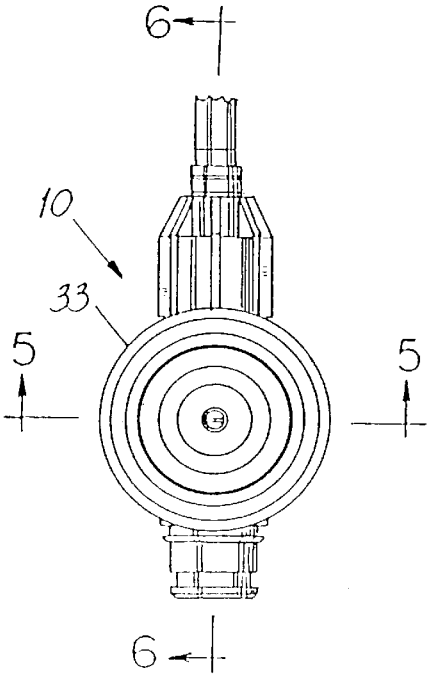
FIG. 4 is a top plan view of the eductor. A tube attached thereto is broken away.

The new eductor 10 includes a generally tubular body 33 having an inlet end 35 and an outlet section 37, the latter having an outlet fitting 39 attached thereto. Such fitting 39 has a necked-down portion 41 terminating in an outlet port 43. The body 33 is formed (preferably by molding a plastic material) to have a flow guide 47 formed therein. In the embodiment of FIGS. 5 and 6, such flow guide 47 is funnel-like.

A support device 49 is mounted in the body 33 between the flow guide 47 and the outlet fitting 39. The inlet end 35, the flow guide 47, the venturi tube 51, the device 49, the outlet section 37 and the fitting 39 are coaxial along the eductor long axis 53 and are generally concentric with such axis 53. There now follows a detailed explanation of the eductor 10 and of its components and features.

Figure 7:
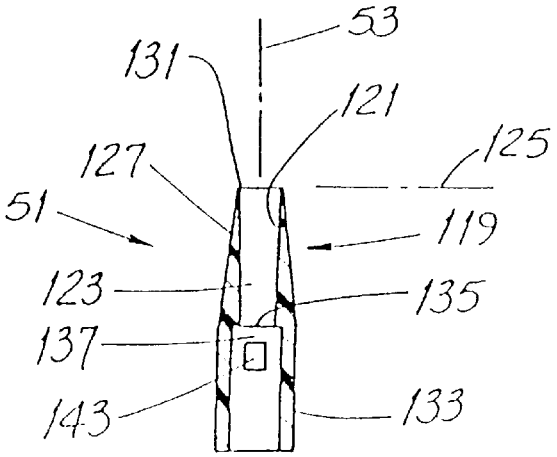
FIG. 7 is an enlarged sectional elevation view of the venturi tube used in the eductor.
Figure 8:
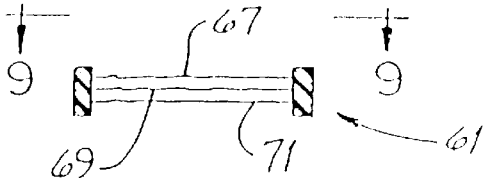
FIG. 8 is a sectional elevation view of one embodiment of a flow-smoothing apparatus.
Figure 21:
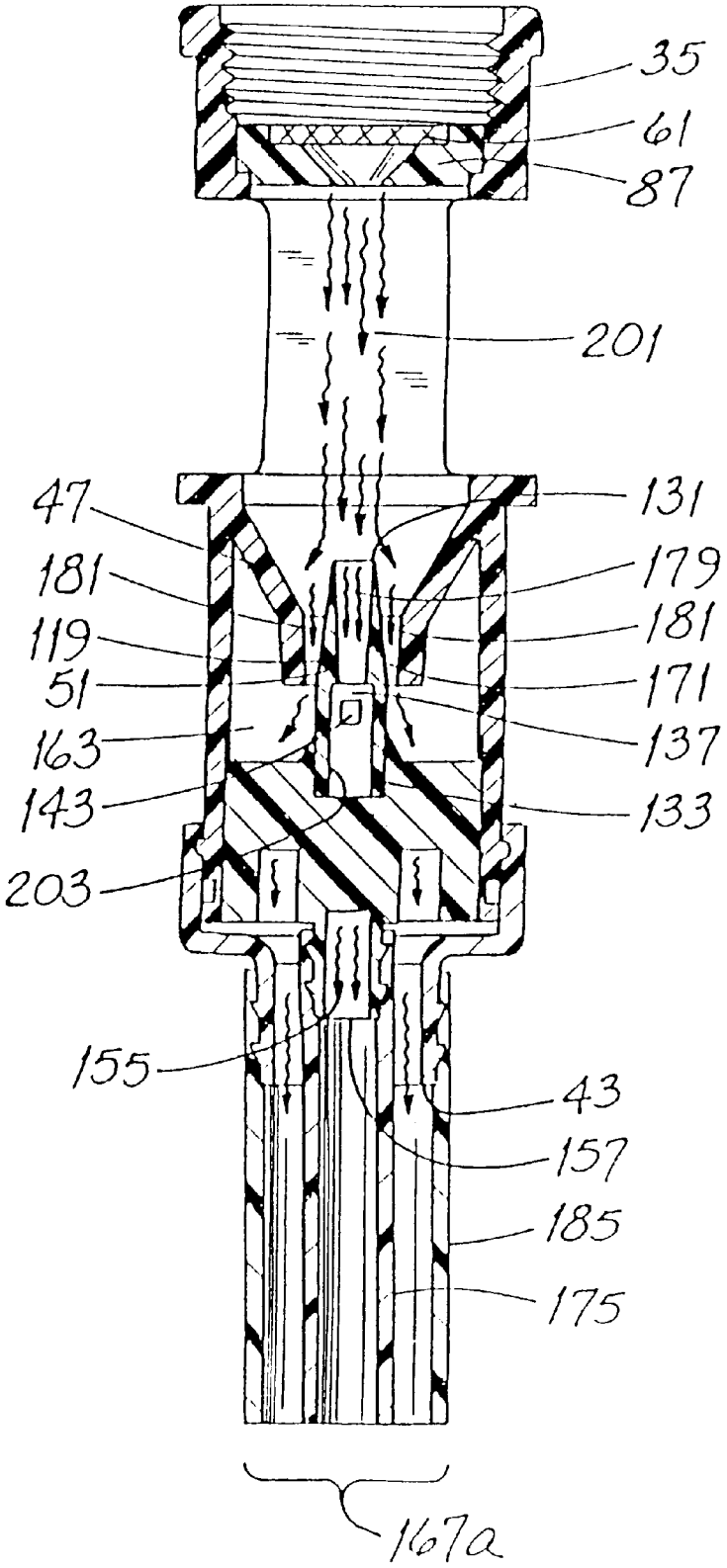
FIG. 21 is a sectional elevation view of the eductor generally like the view of FIG. 5.

Referring again to FIGS. 1 through 7 and also to FIGS. 8 and 21, the inlet end 35 includes a threaded portion 55 for attachment to a pipe 25 in the equipment 11 or, in other uses, to a water faucet for example. Downstream of the portion 55 and positioned at the location 59 is an apparatus 61 for "smoothing" turbulent liquid entering the inlet end 35 and causing such liquid to exhibit substantially laminar flow rather than turbulent flow. (The downstream direction is indicated by the arrow 63.)

Figure 9:
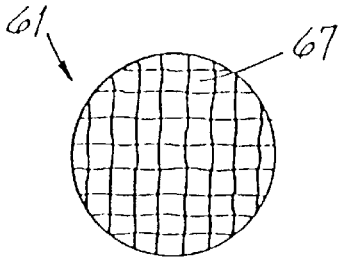
FIG. 9 is a plan view of one variant of the embodiment of FIG. 8 taken along the viewing plane 9—9 thereof.
Figure 10:
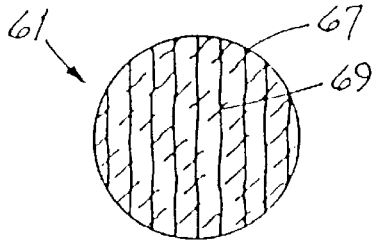
FIG. 10 is a plan view of another variant of the embodiment of FIG. 8 taken along the viewing plane 9—9 thereof.
Figure 12:
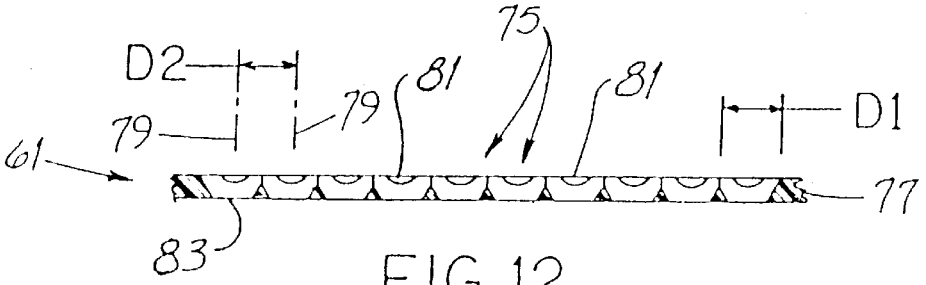
FIG. 12 is a sectional elevation view of the apparatus of FIG. 11 taken along the viewing plane 12—12 thereof. Part is broken away.
Figure 13:
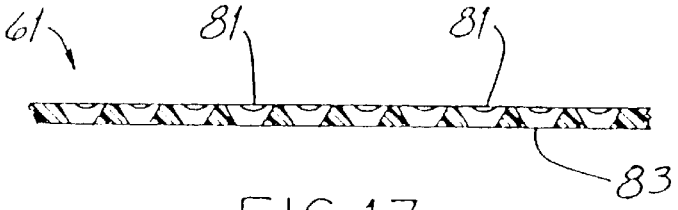
FIG. 13 is a sectional elevation view of the apparatus of FIG. 11 taken along the viewing plane 13—13 thereof. Part is broken away.
Figure 14:
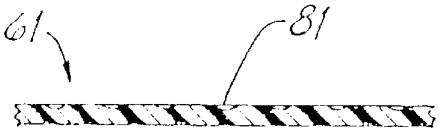
FIG. 14 is a sectional elevation view of the apparatus of FIG. 11 taken along the viewing plane 14—14 thereof. Part is broken away.
Figure 11:
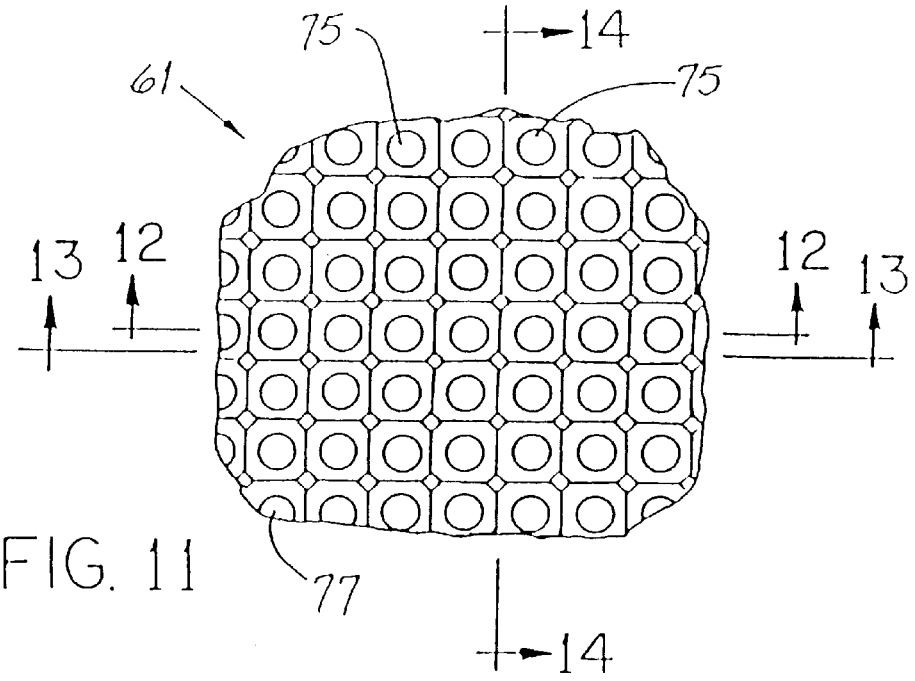
FIG. 11 is a top plan view of another embodiment of a flow-smoothing apparatus. Part is broken away.
Figure 15:
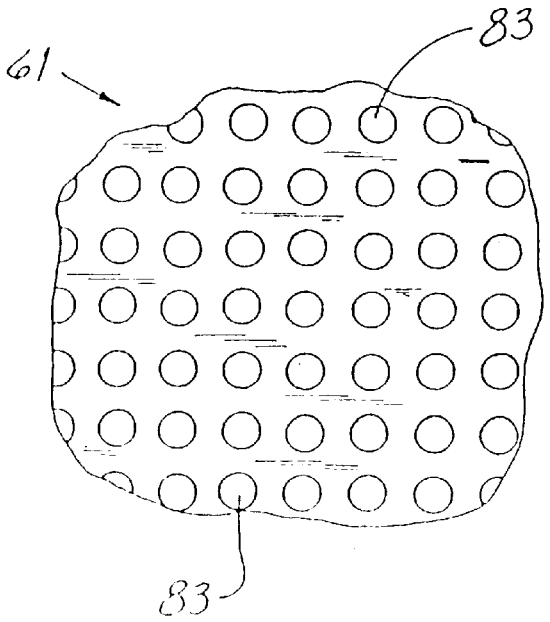
FIG. 15 is a bottom plan view of the apparatus of FIG. 11. Part is broken away.

In the embodiment of FIGS. 8, 9 and 10, the apparatus 61 includes a plurality of spaced screens 67, 69, 71 vertically aligned with one another in an overlapping, series flow, coaxial relationship. In variant embodiments, such screens 67, 69, 71 may be in registry with one another as shown in FIG. 9 or angled to one another as shown in FIG. 10. While three screens 67, 69, 71 are shown in FIG. 8, the apparatus 61 works well using any two of the three screens 67, 69, 71.

Another embodiment of the apparatus 61 shown in FIGS. 11, 12, 13, 14 and 15, includes a plurality of downwardly-converging passages 75 formed in the body 77 of such apparatus 61. Each such passage 75 is shaped like a truncated cone and, most preferably, all passages 75 have the same top diameter dimension D1, the same diameter of outlet hole 83 and the same rate of taper. Each passage 75 is of circular cross-section along its length and the center axes 79 of such passages 75 are spaced by a dimension D2 which is somewhat less than the top diameter D1. That is, such passages 75 are in overlapping relationship.

When so formed, each passage 75 "breaks into" one or more adjacent passages 75 and "upstream-pointing" sharp edges 81 are thereby formed. It has been found that this embodiment with its sharp edges 81 is extremely effective in providing laminar output flow even though liquid flowing into the apparatus 61 exhibits turbulent flow.

A specific apparatus 61 is a disc having a matrix of passages 75 in overlapping relationship. The centerline axes 79 of such passages 75 are spaced by a distance of 0.030 inches (0.76 millimeters), the downstream outlet opening 83 has a diameter of 0.020 inches (0.51 millimeters), the diameter of the apparatus 61 is about 0.70 inches (about 1.75 cm) and the included angle of taper is in the range of 2°–4°. However, such dimensions and angle can vary widely so long as the aforementioned sharp edges 81 are provided.

Referring now to FIGS. 2, 5, 6, 16, 17 and 21, a supply nozzle 87 is mounted in the inlet end 35 downstream of the apparatus 61. Such nozzle 87 has a substantially knife-edged opening 89 forming a first flow area A1 for discharging liquid to the venturi tube 51. This opening is "knife-edged" or sharp-edged in that the ratio of the diameter DF of the opening 89 to its axial length L1 is between about 15:1 and about 25:1. In a specific embodiment, the axial length L1 of the opening 89 is no more than about 0.010 inches (0.25 mm) and the diameter of such opening 89 about 0.200 inches (5.1 mm). The foregoing configuration of the supply nozzle 87 helps minimize resistance to liquid flow.

In other aspects of the nozzle 87, the ratio of the axial length AL of the tapered portion of the nozzle 87 to the diameter DF of the nozzle opening 89 is in the range of 0.7 to 1.1. In a specific embodiment, such ratio is about 0.87.

Referring now to FIGS. 1, 2, 3, 5 and 6, the eductor 10 has a pair of arc-shaped, diametrically-opposed ribs 95, 97 which are circumferentially spaced from one another. The diametrically-opposed openings 99, 101 bounded by and defined by such ribs 95, 97 form an anti-siphon air gap 103.

Such air gap 103, provided to conform to plumbing codes, prevents liquid from backflowing into an equipment branch pipe 25 or into a water faucet. The existence of such air gap 103 is also visually apparent and the openings 99, 101 are sufficiently large that a human adult finger can be thrust therethrough. In a specific embodiment, each of the openings 99, 101 is slightly longer than one inch (2.54 cm) measured parallel to the long axis 53 of the eductor 10 and each spans an arc of about 90°.

Figure 16:
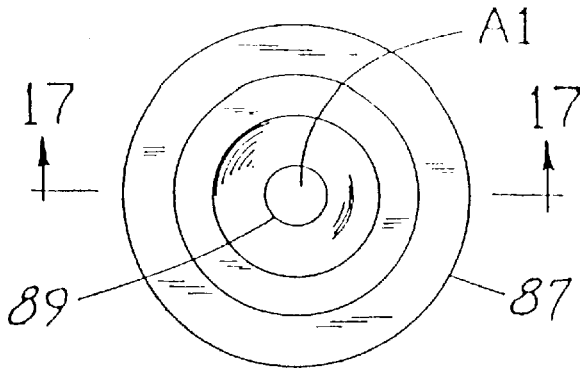
FIG. 16 is an enlarged top plan view of a supply nozzle used in the eductor.
Figure 17:
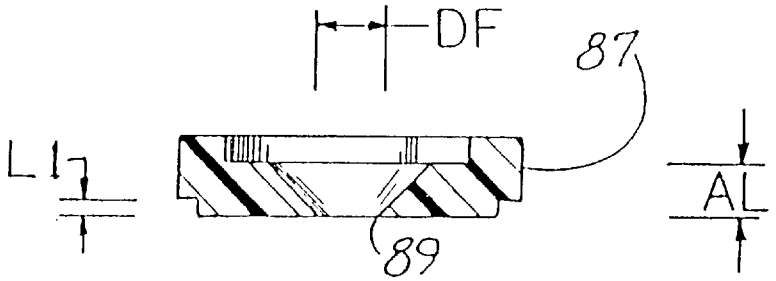
FIG. 17 is a sectional elevation view of the nozzle of FIG. 16 taken along the viewing plane 17—17 thereof.

Referring now to FIGS. 5, 6 and 16, the flow guide 47 has a dual taper with a first portion 107 which, considered in an upstream-to-downstream direction, converges. Convergence is at a first included angle FA1. The guide 47 also has a second portion 109 converging at a second included angle FA2 that is less than the first angle FA1. Preferably, the first angle FA1 is between about 40° and about 80° and, most preferably, such first angle FA1 is about 60°. Preferably, such second angle FA2 is between about 5° and about 15° and, most preferably, such angle FA2 is about 10°.

The portions 107, 109 abut at a junction 111 which defines a second flow area A2 and the ratio of the second flow area A2 to the first flow area A1 is between about 1.05:1 and about 2:1. This allows the eductor 10 to accommodate a range of water pressure and also results in flow which is more laminar. The positional relationship of the flow guide 47 and the venturi tube 51 and the manner in which such guide 47 and tube 51 coact is described below following the more-detailed descriptions of other aspects of the eductor 10.

Figure 2:
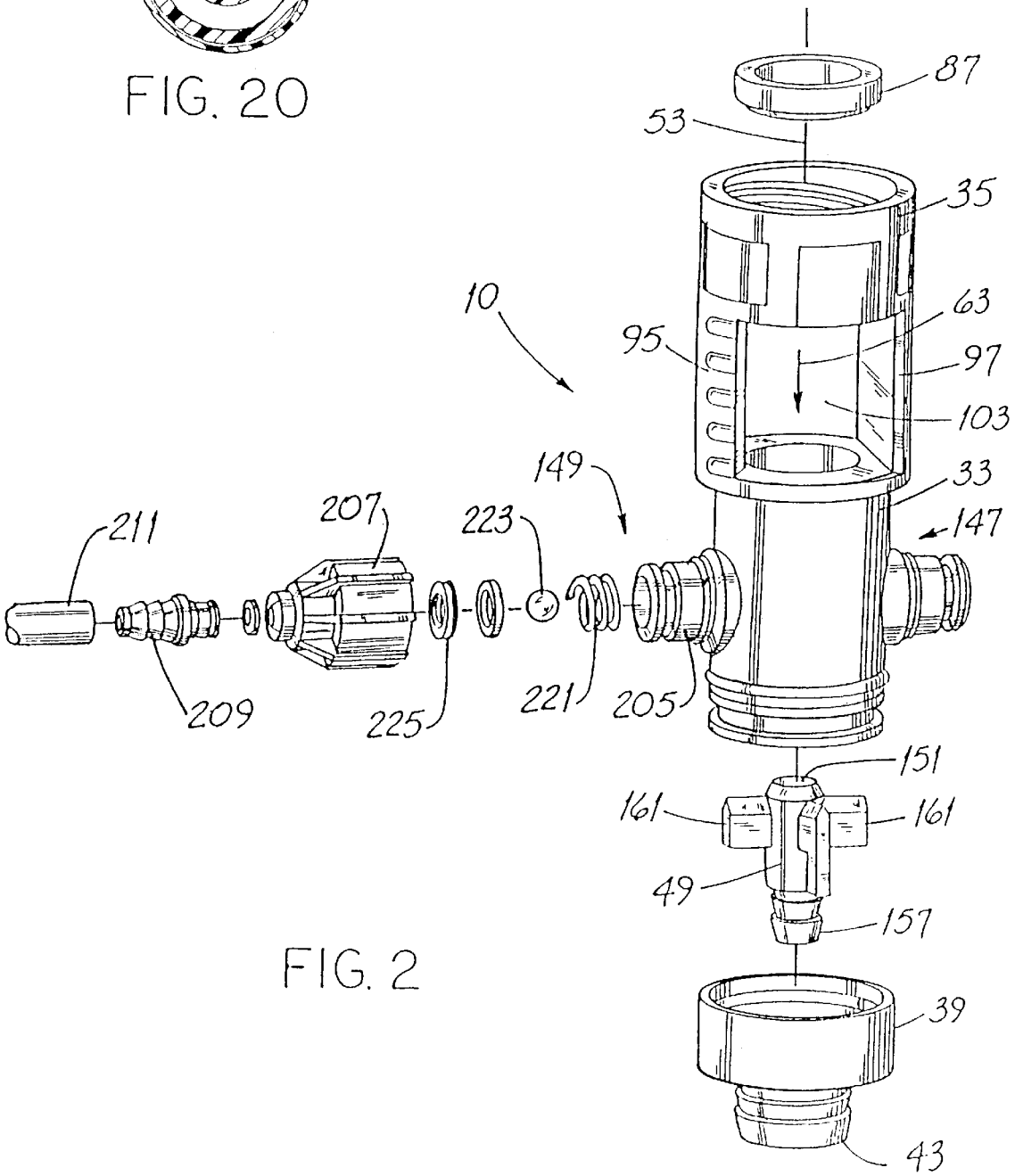
FIG. 2 is an exploded perspective view of the eductor.

Referring now to FIGS. 2, 6 and 7, the venturi tube 51 is secured coaxially in the body 33 by a pair of radial, molded panels 115, 117 circumferentially spaced by about 180°. Preferably, the body 33, the tube 51 and the panels 115, 117 are formed as a unitary structure. The upper portion 119 of the tube 51 includes an interior surface 121 converging in a downstream direction and forming part of a conduit 123. The interior surface 121 defines an inverted cone truncated at a plane 125 normal to the axis 53.

The outward surface 127 of such portion 119 diverges in a downstream direction and the exterior shape of such surface 127 (and the tube sharp edge 131) generally define an upright truncated cone. More specifically, the sharp edge 131 is defined by the intersection of the interior surface 121 and the outward surface 127. That length of conduit 123 in the lower portion of the tube 51 is generally cylindrical, diverging in a downstream direction only slightly for mold draft purposes.

Referring particularly to FIGS. 7 and 21, the junction 135 of the tube portions 119 and 133 is substantially at or at least closely adjacent to the region 137 of highest liquid velocity and lowest pressure. Referring also to FIG. 6 in an optional embodiment, the eductor 10 has a plurality of channels 141, 143, each extending through a respective panel 115, 117 and each in flow communication with the tube 51 (and, particularly, with its region 137) and with respective input ports 147, 149 to which containers 15 of concentrates or other liquids 17 are connected.

So configured, the eductor 10 permits mixing either or both of two other liquids 17 with water and/or to obtain a solution at the outlet port 43 having either of two dilutions. Other ways in which this embodiment can be used are described near the end of the specification.

Referring now to FIGS. 2, 5 and 6, the support device 49 includes a pocket 151 snugly fitted to the venturi tube 51. In that way, the relative axial and radial positions of a rectangular, axially-disposed, axially-elongate reed member 153 and of the output end of the venturi tube 51 may be precisely maintained. The reed member 153 diametrically spans the axial hole 155 in the support device 49.

The support device 49 has a lower member 157 and plural radially-extending arms 161 (four arms 161 in the illustrated embodiment) extending from the device 49 and friction-fitted against the inner wall of the eductor body 33. Such arms 161 maintain the radial position of the pocket 151 with respect to the eductor body 33. The purpose of the "baffle-like" reed member 153 is set out below in the description of operation.

Referring now to FIGS. 5, 6 and 18, the outlet section 37 of the eductor 10 has a deceleration chamber 163 that reduces the velocity of the secondary stream bypassing around (rather than passing through) the venturi tube 51 and thereby tends to "quiet" such stream. The cross-sectional area of the chamber 163 is represented in FIG. 19A and is a quadrifid area. That is, such area has four arc-shaped parts 165 (in the view of FIG. 19A).

Figure 20:
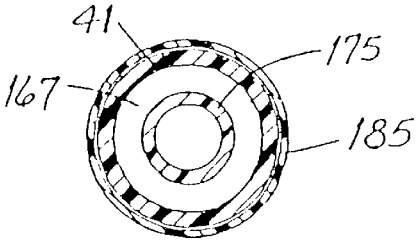
FIG. 20 is a sectional plan view taken along the viewing plane 20—20 of FIG. 18.

The maximum cross-sectional area of the chamber 163, shown in FIG. 19B to have two arc-shaped parts 165, each spanning about 180°, is substantially greater than the maximum area of the annular space 167 forming the combining zone 167*a* shown in FIGS. 18, 20 and 21. And, of course, the volume of the chamber 163 is much greater than the volume of the annular region 171 between the flow guide 47 and the tube 51. As described in more detail below, the deceleration chamber 163 permits the velocity of liquid flowing through it to diminish markedly, thus reducing the tendency toward foaming. From the foregoing, it is apparent that liquid bypassing the venturi tube 51 flows through the arc-shaped parts 165 and is ultimately discharged from the eductor 10.

Referring to FIG. 18, the annular space 167 forms a combining zone 167*a* downstream of the deceleration chamber 163. In such zone 167*a* (and assuming the interior hose 175 is not used), the secondary stream 181 and the primary stream 179 (the latter then including, e.g., a cleaning concentrate) may be combined to form a solution mixed in the desired ratio. The cross-sectional area of the combining zone 167*a* is preferably substantially less than the cross-sectional area of the chamber 163.

The eductor 10 may used in combination with concentric interior and exterior hoses 175 and 185, respectively. So used, both hoses 175, 185 (which are coextensive) are inserted into the mouth of a container used by custodial staff. Each hose 175, 185 has a downstream terminus 189 and 191, respectively, and the termini 189, 191 are substantially coincident. In this combination, the combining zone 167*a* is at the termini 189, 191 where the "rich" concentrate solution flowing through the hose 175 and the water flowing through the annular region 171 are merged. In the alternative, the eductor 10 may be used in combination with only the exterior hose 185. In this combination, the combining zone 167*a* is located as described in the preceding paragraph.

Figure 24:
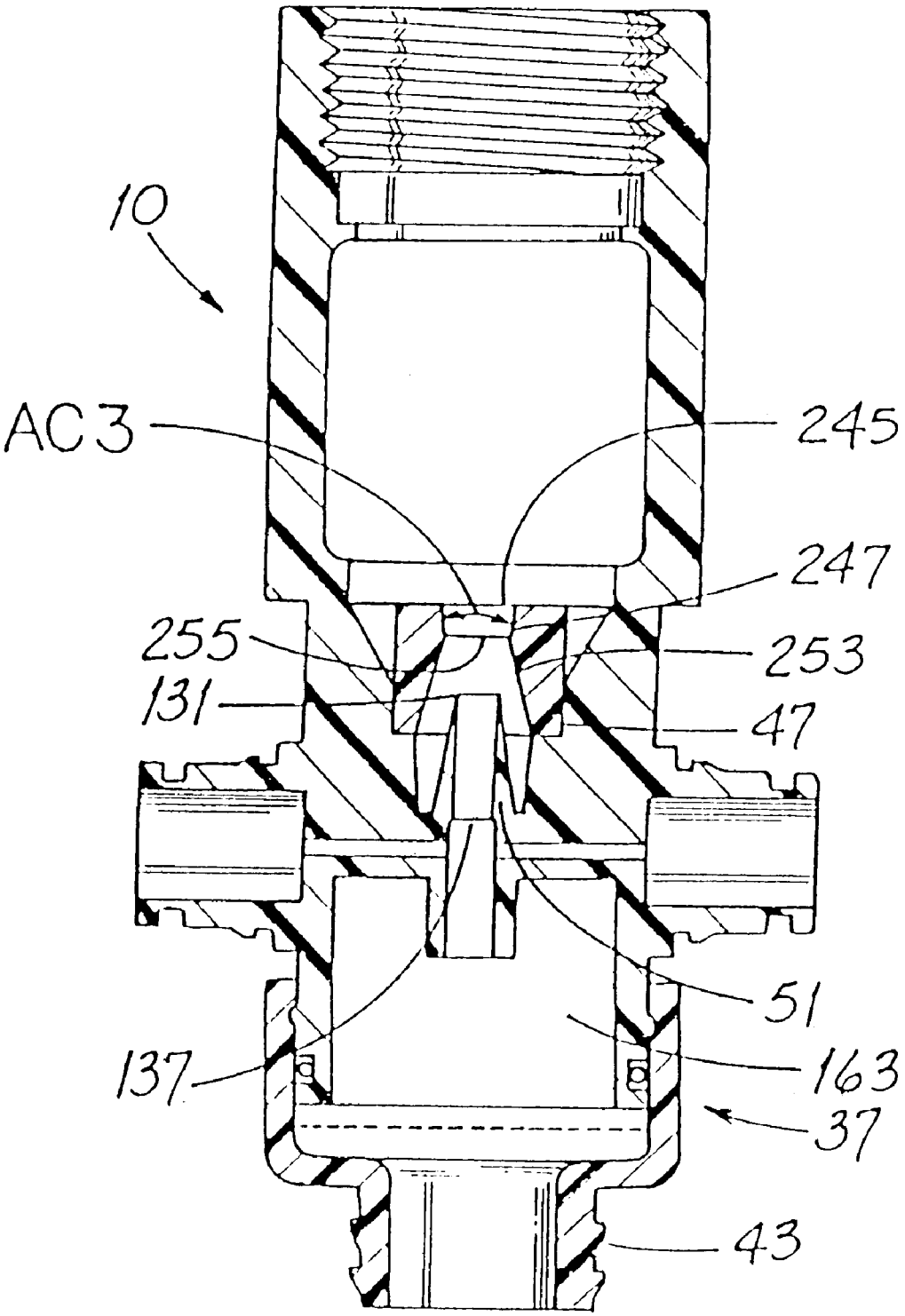
FIG. 24 is a sectional elevation view of yet another embodiment of the new eductor.

Optionally, the eductor 10 also includes a secondary apparatus 195 for enhancing the degree to which the liquid in the secondary stream 181 is laminar. The apparatus 195, which may be a screen, is positioned somewhat upstream of the end of the lower member 157 so that improved laminarity is imparted to such secondary stream 181 before it is combined in a zone 167*a* with the primary stream 179. This also reduces the tendency to foam. Referring to FIG. 24, the secondary apparatus 195 may be positioned near the bottom of the deceleration chamber 163 rather than in the necked-down portion 41 as shown in FIG. 6.

The new eductor 10 functions as follows. Referring to the FIGURES and, particularly, to FIGS. 1, 8–10 and 21, it is assumed that the eductor 10 is mounted in dispensing equipment 11, that the inlet end 35 is connected to a branch pipe 25 and the header 23 and that the outlet port 43 is connected to a single discharge hose 185 or that the port 43 and the lower member 157 are connected to the hoses 185 and 175, respectively. In operation, water under pressure (the "first liquid") flows into the end 35 and through the apparatus 61 and the nozzle 87 in a main stream 201 which is substantially laminar. Such stream 201 has a diameter somewhat greater than the diameter of the edge 131 of the venturi tube 51. The main stream 201 is thereby "sliced" or divided into a columnar primary stream 179 passing through the tube 51 and an annular secondary stream 181 passing around and spaced from the primary stream 179.

The flow guide 47 is annular around the venturi tube 51 and the tube 51 and the guide 47 are in spaced telescoped relationship and define an annular region 171 between them. The secondary stream 181 fills the region 171 and thereby provides what may be termed a seal preventing air from passing through the region 171. The secondary stream 179 fills the tube upper portion 119. It is believed that the aforedescribed seal feature is responsible, at least in part, for the back pressure tolerance and for the aeration-reducing performance of the new eductor 10.

The primary stream 179 flows through the tube upper portion 119 and through the low-pressure region 137, thereby inducing a second liquid to flow through a channel 143 to join the primary stream 179. A diluted but somewhat "rich" solution of the first and second liquids is thereby formed. Such solution flows through the tube lower portion 133 where it is mixed in a combining zone 167*a* with the secondary stream 181 to form the desired, more-dilute solution. The more-dilute solution is thereupon expelled.

It is to be appreciated that during the above-described activity, the secondary stream 181 flows through the annular region 171 and into the deceleration chamber 163. Whatever the velocity of the secondary stream 181 as it flows through the region 171, such velocity will be diminished upon entry of the secondary stream 181 into the chamber 163. The secondary stream 181 will thereby be "quieted." The flow of the secondary stream 181 into a combining zone 167*a* is thus more likely to be laminar rather than turbulent.

Referring also to FIG. 6 and considering the reed member 153, the primary stream 179 flowing through the tube 51 is typically extremely laminar and has substantially no entrained air other than any small amount of air in the water coming into the eductor 10. Therefore, the primary stream 179 may not intimately contact the downstream wall 203 of the venturi tube lower portion 133 and/or may not intimately contact the circumferential side of the hole 155. Absent such contact, air may enter the tube 51 and impair venturi action. The reed member 153 may be used to spread the primary stream 179 and help assure that it makes sealing contact.

Referring now to FIGS. 1, 2, 6 and 22, a specific embodiment of the eductor 10 has an input port 149 including a receiving boss 205, a concentric cap 207 around the boss 205 and a barbed fitting 209 into the cap 207 for attachment of a tube 211 extending between the port 149 and a container 15 of concentrated cleaning liquid 17, for example. The cap 207 has an internal circumferential groove 213 that "snap-fits" to a retaining ridge 217 and cap/boss sealing is by an O-ring 219.

Within the port 149 is a compression spring 221 urging a check ball 223 against a quad-ring seal 225. Vacuum developed in the venturi tube 51 causes a pressure differential across the ball 223 which is sufficient to further compress the spring 221 and move the ball 223 to a position spaced from the quad-ring seal 225. Liquid 17 can thereupon flow through a channel 143, 141 into the venturi tube 51. In a specific embodiment, the boss 205 and the cap 207 are closely fitted at the junction 227, thereby making it difficult to insert a tool therebetween and remove the cap 207.

Referring next to the FIGURES and particularly to FIGS. 1 and 6, as noted above, the eductor 10 may have plural channels 141, 143 for flowing concentrates or the like into such eductor 10. Considering eductor 10*a* in FIG. 1, the equipment user may obtain a solution of water and either of the liquids 17, 17*b* (i.e., second and third liquids) in the containers 15, 15*b*. To do so, either the valve 231 or the valve 233 is opened. This arrangement prevents cross-contamination of feed lines that may occur using a conventional eductor with a single channel.

In the alternative, both the second and third liquids 17, 17*b* may be mixed with water. To do so, both valves 231 and 233 are opened simultaneously.

Considering eductor 10*b*, one may also aerate a solution by leaving one channel 141, 143 open to atmosphere as represented by the open-ended line 235. A liquid flows from a container 15 into the eductor 10b through another line 237 and mixes with air entering through the line 235.

Considering eductor 10*c*, one may also obtain either of two dilution ratios or "strengths." A particular dilution ratio is obtained by maintaining the valve 239 closed. A "richer" dilution ratio (one having a higher percentage of detergent) is available by opening the valve 239 and permitting the detergent to enter the eductor 10*c* through both channels 141, 143.

The eductor 10*d* is shown to be connected in a conventional way, i.e., with a single container 15 connected to a single input port 149. After appreciating the foregoing, persons of ordinary skill will be able to apply the new eductor 10 in yet other ways.

It is to be understood that providing two channels 141, 143 in the eductor 10 is convenient since, in the preferred embodiment, there are two panels 115, 117, one each extending between the venturi tube and a respective input port 149. However, providing three or more panels and additional channels and inlet ports is contemplated by the invention and is clearly within its scope.

Figure 23:
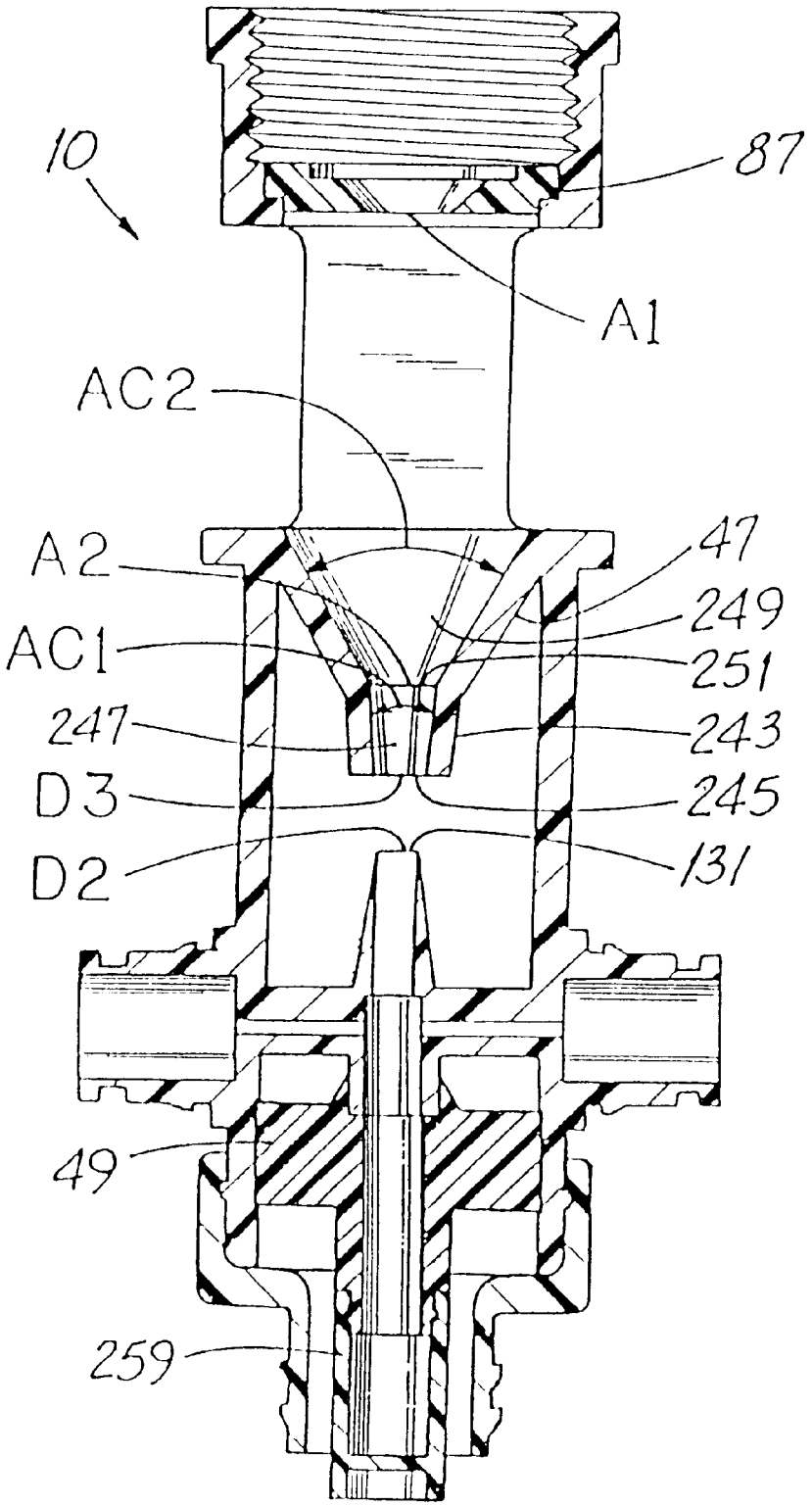
FIG. 23 is a sectional elevation view of another embodiment of the new eductor.

And there are yet other embodiments of the invention. Referring next to FIG. 23, in a highly preferred eductor 10, the lower end 243 of the flow guide 47 (which resembles an upright funnel) is spaced above the venturi sharp edge 131. Such guide 47 has a guide opening 245 through which liquid is directed toward the edge 131. Such edge 131 has an edge diameter D2 and the guide opening 245 has a guide opening diameter D3 greater than the edge diameter D2. The ratio of the diameter D3 of the guide opening 245 to the diameter D2 of the edge 131 is preferably between about 1.01:1 and 1.08:1 and, most preferably, is about 1.034:1.

Such flow guide 47 includes a guide passage 247 converging toward the guide opening 245. The passage 247 defines an angle AC1 of convergence between about 5° and about 15°. Most preferably, such angle AC1 is about 10°.

And there is a wide-mouth collector passage 249 above and converging toward the guide passage 247. The collector passage 249 defines an angle AC2 of convergence between about 40° and about 80° and most preferably, such angle AC2 is about 60°.

The collector passage 249 and the guide passage 247 abut at a junction 251 which defines a flow area A2 and the ratio of the flow area A2 to the flow area A1 is between about 1.05:1 and about 2:1. Liquid flowing through the flow guide 47 seals against the passage 247 and depending upon the diameter of the liquid stream, against the junction 251.

Referring next to FIG. 24, the flow guide 47 resembles an inverted funnel and the guide opening 245 is an input opening to such guide 47. The flow guide 47 has a guide passage 247 below the guide opening 245, above the venturi sharp edge 131 and converging toward such edge 131. A preferred angle AC3 of convergence is between about 5° and about 15°. Most preferably, such angle AC3 is about 10°.

The flow guide 47 further includes a bypass guide 253 in telescoped relationship to the venturi tube 51. Such bypass guide 253 diverges toward the eductor outlet section 37. The guide passage 247 and the bypass guide 253 abut at a circular junction 255 and the ratio of the diameter of the junction 255 to the diameter of the sharp edge 131 is between about 1.07:1 and 1.21:1. Most preferably, such ratio is about 1.14:1. In a specific embodiment, the diameter of the junction 255 is 0.204 inches (5.18 mm) and the diameter of the sharp edge 131 is 0.179 inches (4.55 mm).

Figure 25:
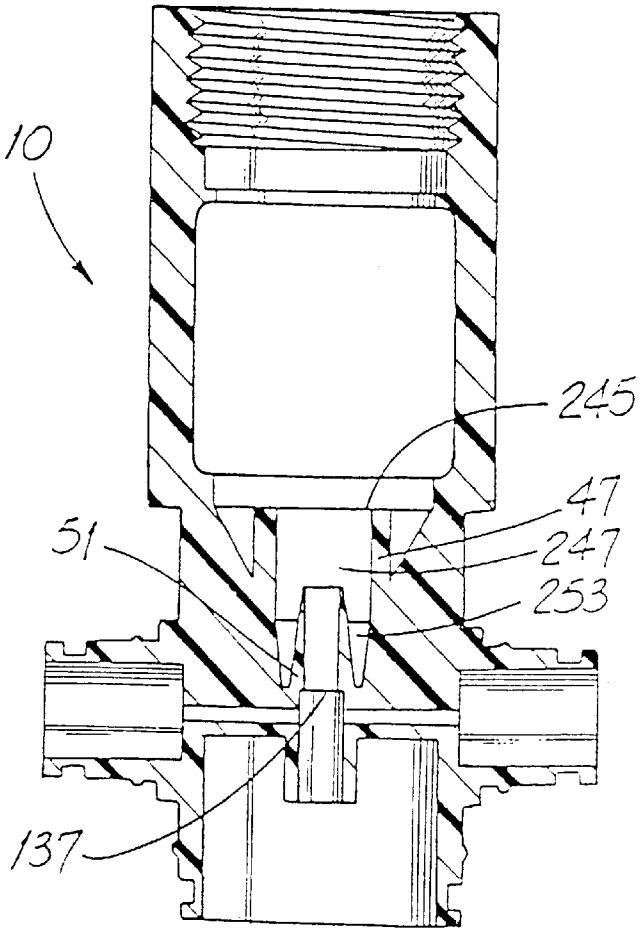
FIG. 25 is a sectional elevation view of still another embodiment of the new eductor. The eductor outlet section, redundant to the view of FIG. 23 if shown, is omitted.
Figure 29:
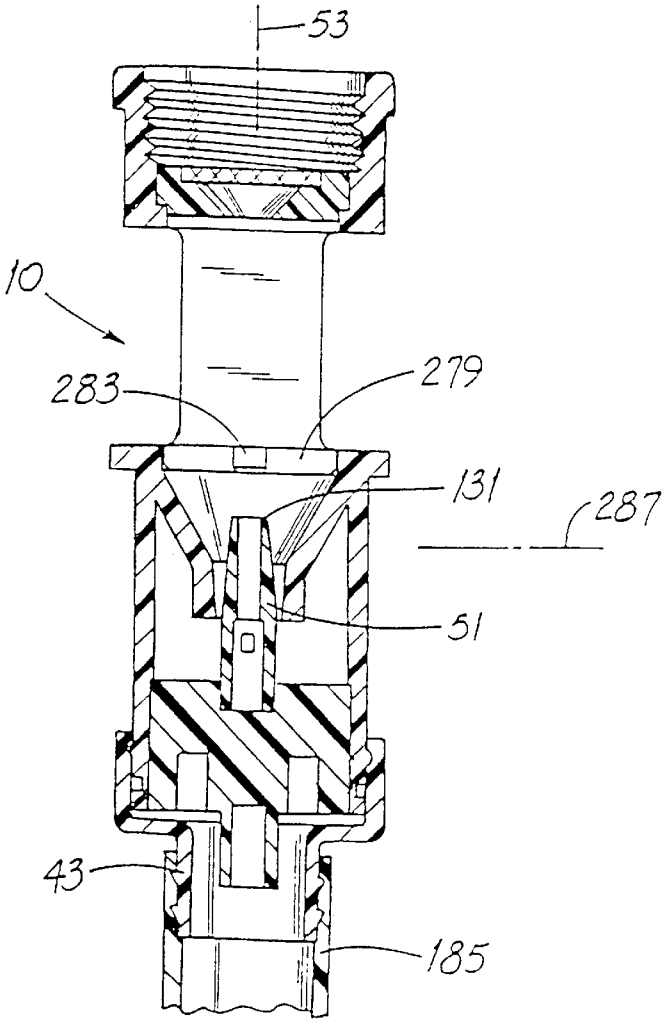
FIG. 29 is a sectional elevation view of an embodiment of the eductor an including a nozzle protector for preventing damage to the sharp edge of the venturi tube.
Figure 26:
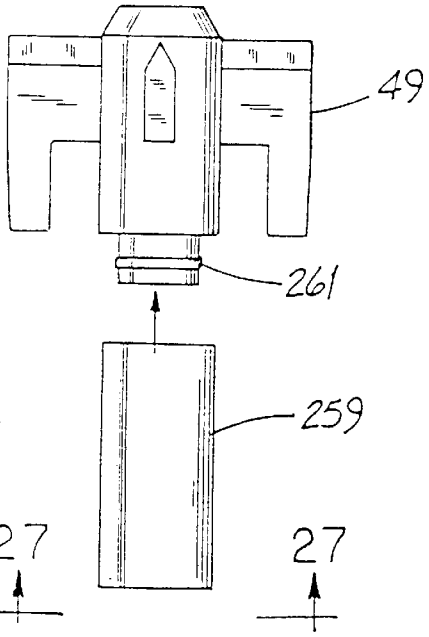
FIG. 26 is an exploded view, in elevation, of a modified support device and flooding pin useful in the new eductor.
Figure 27:
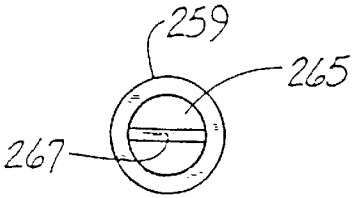
FIG. 27 is a bottom plan view of the flooding pin of FIG. 26 taken along the viewing plane 27—27 thereof.
Figure 30:
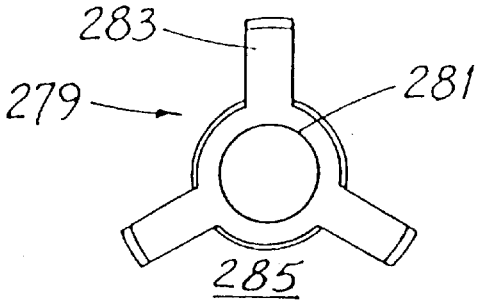
FIG. 30 is a bottom plan view of the nozzle protector shown in FIG. 29.

Referring next to FIGS. 25 and 29, another embodiment of the eductor 10 has a flow guide 47 resembling an upright, open-mouthed standpipe. Such guide 47 includes a guide passage 247 below the guide opening 245 and such passage 247 is substantially cylindrical. The ratio of the diameter of the guide passage 247 to the diameter of the sharp edge 131 is between about 1.8:1 and 2.4:1. Most preferably, such ratio is about 2.1:1. In a specific embodiment, the diameter of the guide passage 247 is 0.380 inches (9.65 mm) and the diameter of the sharp edge 131 is 0.179 inches (4.55 mm). There is also a bypass guide 253 around the venturi tube 51 and converging toward the region of low pressure 137 in such tube 51.

Referring now to FIGS. 23, 26, 27 and 28, another feature of the new eductor 10 (involving a modified support device 49 and a flooding tube 259) may be used with the embodiments of FIGS. 2–6, 18, 25 and 29. (When such device 49 and flooding tube 259 are used with the embodiments of FIGS. 2–6 and 18, the reed member 153 is omitted.) The support device 49 of FIGS. 26 and 28 has a circumferential ridge 261 that engages a groove 263 in the flooding tube 259. The device 49 and the tube 259 "snap fit" together.

The tube 259 has a passage 265 therethrough and there is a flooding pin 267 extending diametrically across the passage 265. The pin 267 disrupts the flow of liquid along the passage 265 and helps assure that such liquid is in intimate contact with the passage 265, thereby sealing such tube 259 and preventing air from backflowing up the tube 259 to the venturi tube 51.

Figure 31:
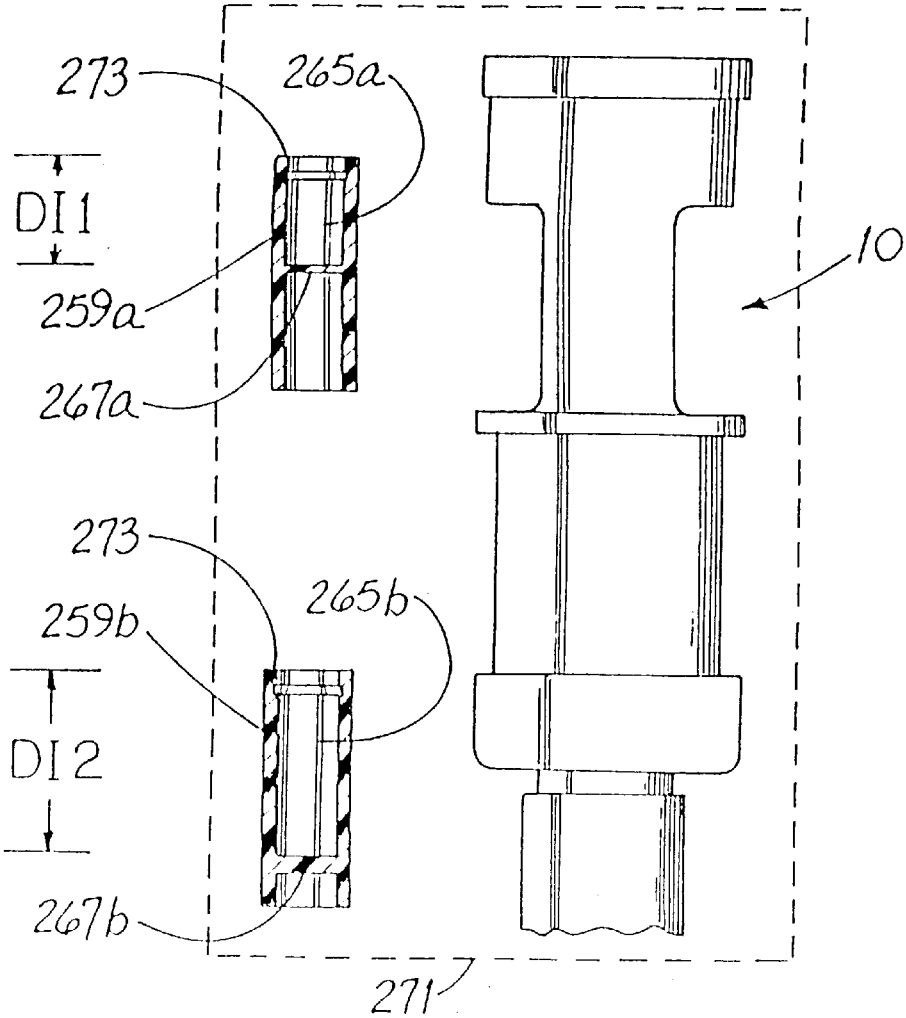
FIG. 31 represents a kit including an eductor and plural flooding tubes. Such tubes are shown in section view.

Referring also to FIGS. 25, 29 and 31, the eductor 10 may be packaged as a kit 271 having an eductor 10 and first and second flooding tubes 259*a* and 259*b*, respectively. Each tube 259*a*, 259*b* has an inlet end 273, respective first and second passages 265*a* and 265*b*, and respective first and second pins 267*a* and 267*b*. The pins 267*a*, 267*b* are spaced below (downstream of) the inlet end by a dimension DI1 or DI2.

Figure 28:
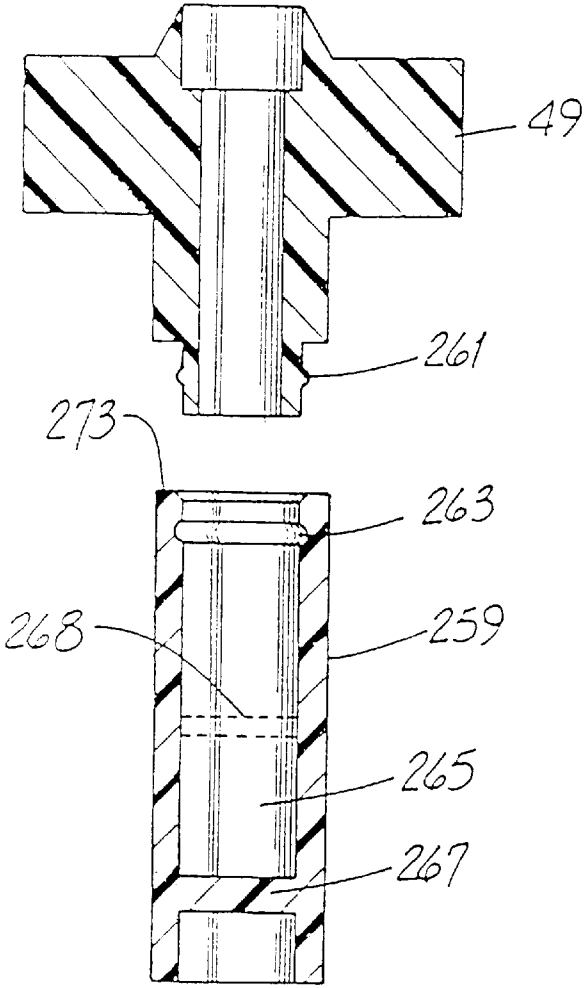
FIG. 28 is a sectional elevation view of the support device and flooding pin shown in FIG. 26.

The pins 267*a*, 267*b* may be of differing diameter (as they are shown in FIG. 31) or the pins 267*a*, 267*b* may be of the same diameter but spaced below the inlet ends 273 of their respective flooding tubes 259*a*, 259*b* by differing dimensions DI1, DI2. (The dashed outline 268 in FIG. 28 represents a flooding pin that is spaced differently from the inlet end 273 and has a different diameter than the pin 267 shown in such FIGURE.) After appreciating the specification, one of ordinary skill will recognize that each flooding tube 259*a*, 259*b* may have a pin diameter and pin spacing from tube inlet end 273, both of which differ from the diameter and spacing of the other tube 259*b*, 259*a*. The vacuum produced at the region of lowest pressure 137 may be adjusted by changing the diameter of a passage 265, by changing the diameter of a flooding pin 267 and/or by changing the location of such pin 267 with respect to the tube inlet end 273.

Referring to FIGS. 5, 23, 24 and 25, it is preferred that the passages 247, 249 of the flow guide 47 and the passage 265 of the flooding tube 259 be highly-polished to reduce friction and permit liquid to make more intimate sealing contact therewith. In a preferred embodiment, the finish of such passages 247, 249, 265 is in the range of 3 to 10 microns and most preferably is in the range of 5 to 8 microns.

Referring next to FIGS. 2, 5, 6, 29 and 30 (and particularly the latter two FIGURES) in a highly preferred eductor 10, the venturi tube 51 has an annular sharp edge 131 as noted above. A person may thrust a finger into the eductor air gap 103 provided by the opening 101 and, perhaps, touch and damage the tube edge 131. Therefore, it is particularly desirable with the embodiment of FIGS. 5, 6, 29 and 30 to interpose a nozzle protector 279 between the air gap 103 and the venturi tube 51. An exemplary protector 279 has a central support portion 281, radially-extending arms 283 and generously-sized notches 285 between respective pairs of arms 283. Such protector 279 provides a barrier sufficient to prevent inadvertent finger contact with the tube sharp edge 131.

Referring to the FIGURES, having described a number of embodiments of the new eductor 10, several observations can be made regarding performance. Using a venturi tube 51 with a sharp edge 131 dramatically reduces liquid splashing. And using a tube 51 with an outward surface 127 which slightly diverges in a downstream direction helps guide liquid in the secondary stream 181 into the deceleration chamber 163.

The embodiments of FIGS. 24 and 25 tolerate back pressure particularly well. If the eductor 10 has a hose 185 attached to the outlet port 43 (as in FIG. 29) for washdown or spraying purposes, such hose 185 may be oriented horizontally, lifted above the eductor 10 or pointed upwardly and the eductor 10 (which is assumed to be mounted vertically as shown) continues to function very well without flooding or significant backsplashing.

In the embodiment shown in FIG. 24 the eductor 10 operates quietly, decreases foaming and very quickly generates vacuum in the region of low pressure 137. The embodiments of FIGS. 23, 24 and 5, 6, 29 (all of which have a slightly-converging guide passage 47 as shown in FIGS. 23–25) exhibit good tolerance for an off-center (i.e., slightly non-concentric with the axis 53) main stream 201 and a variety of main stream diameters. Such diameters are likely to result if an eductor 10 is used with differing inlet pressures. And the slightly-converging guide passage 47 makes the eductor 10 more tolerant of eductor mounting orientations other than vertical.

Figure 32:
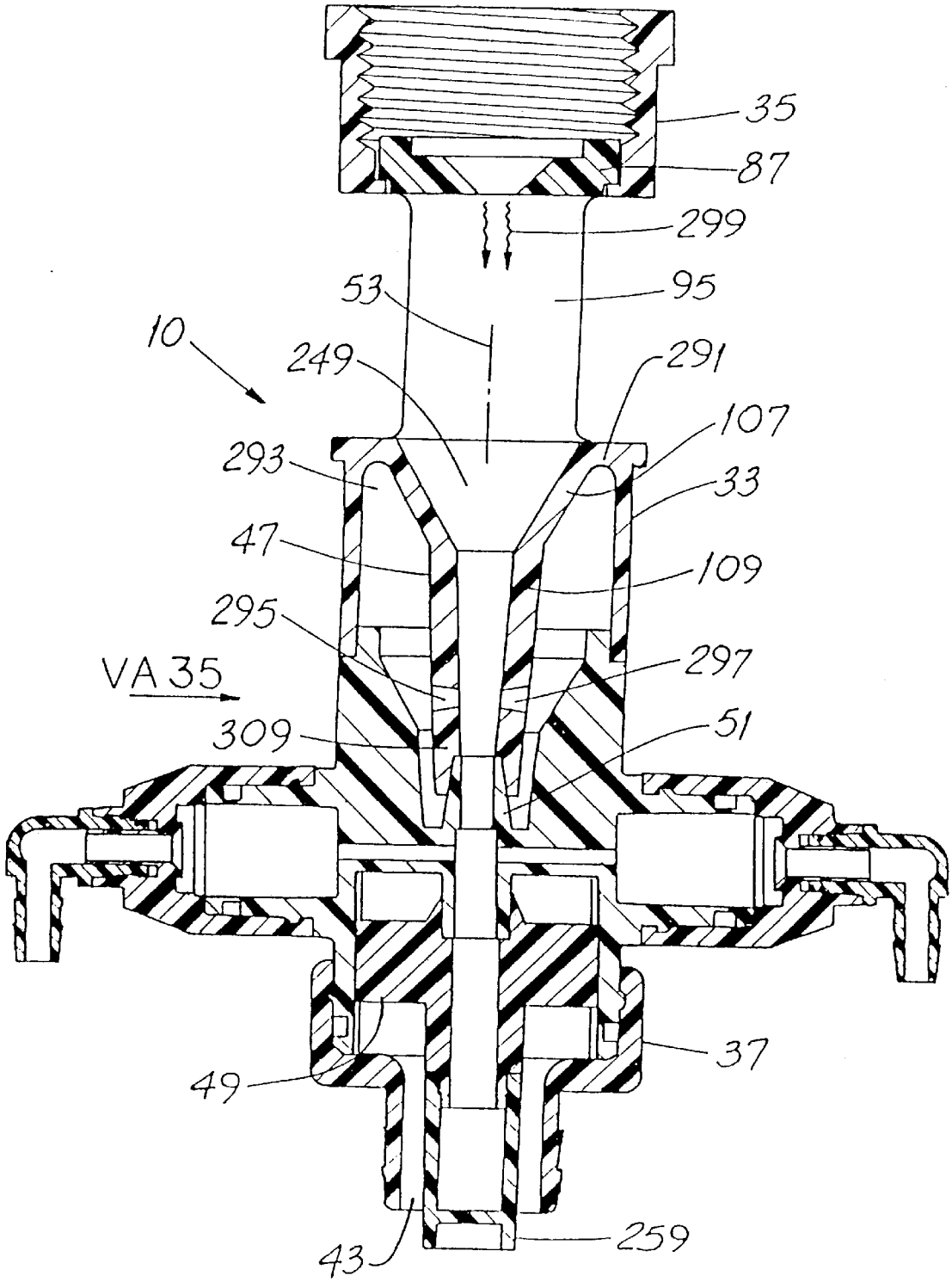
FIG. 32 is a sectional elevation view of another embodiment of the new eductor.
Figure 33:
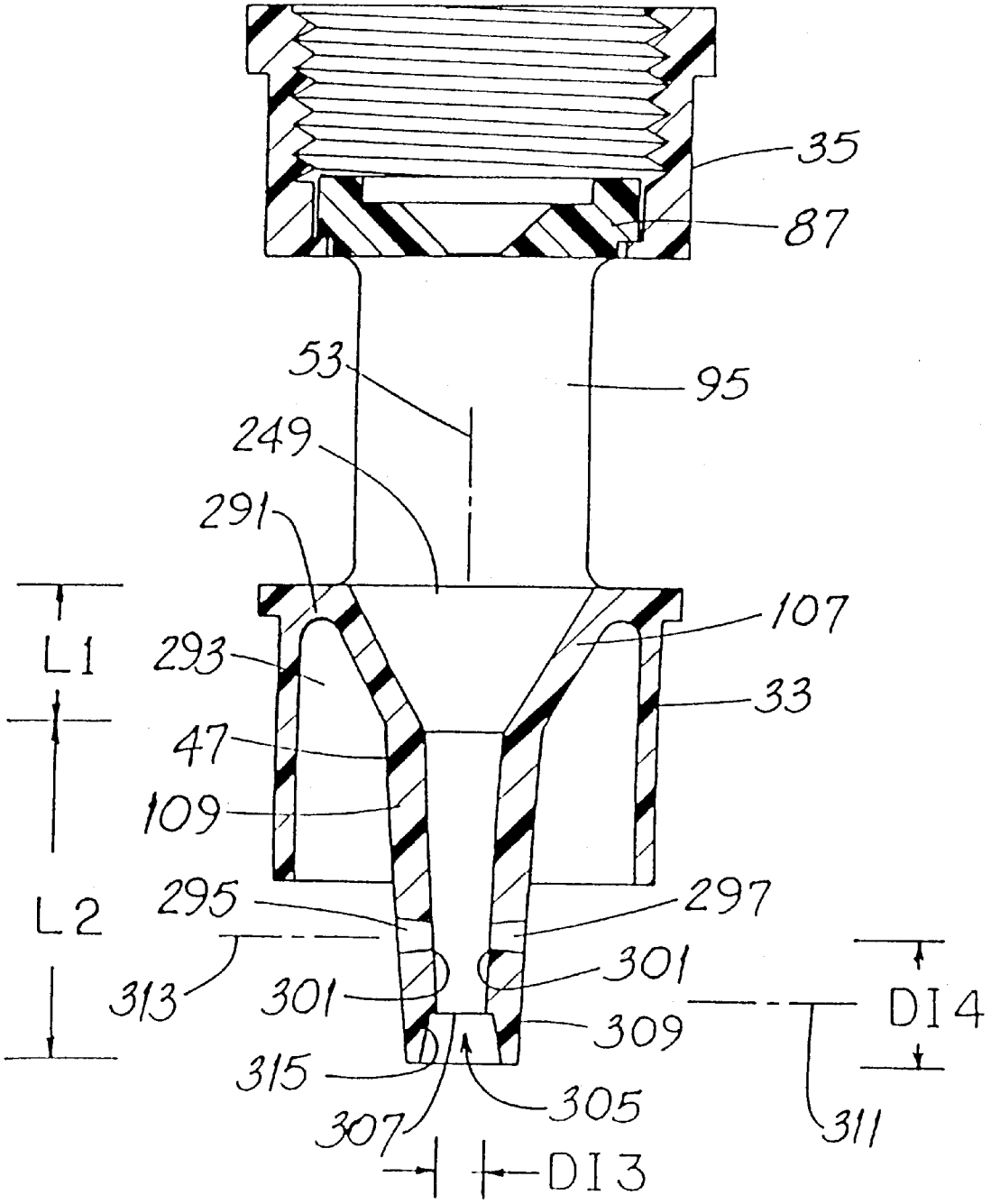
FIG. 33 is a sectional elevation view of the upper body of the eductor of FIG. 32.
Figure 34:
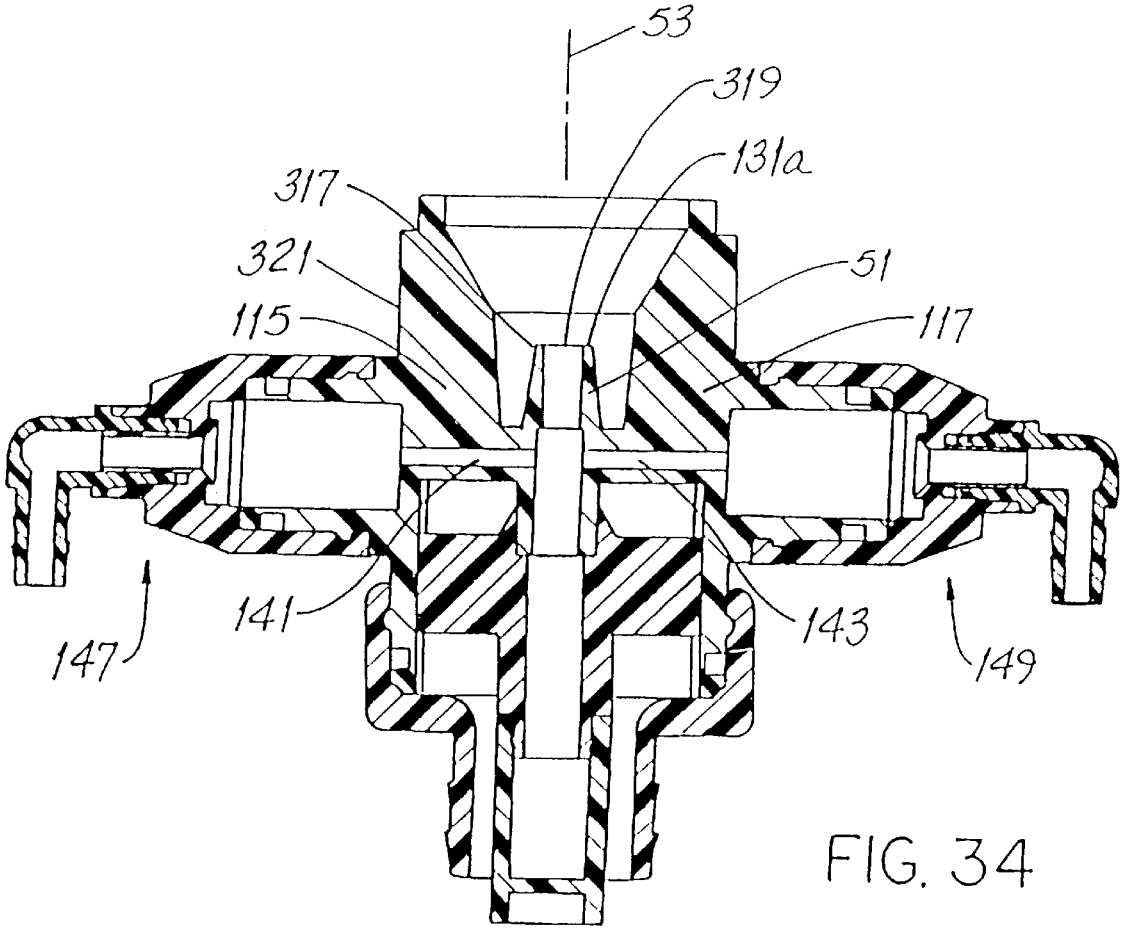
FIG. 34 is a sectional elevation view of the lower body of the eductor of FIG. 32.

Referring next to FIGS. 6, 32, 33, 34 and 35, another embodiment of the eductor 10 includes a body 33 with an inlet end 35, a supply nozzle 87 and a pair of ribs 95, 97. While only one rib 95 is shown in FIGS. 32 and 33, the ribs 95, 97 define an air gap 103 as shown in FIG. 6. As seen in FIGS. 6 and 8–15, the eductor 10 may include a smoothing apparatus 61 at location 59.

The eductor 10 also has a flow guide 47 having a first or upper portion 107 and a second or lower portion 109 extending downwardly from the first portion 107. An imperforate wall 291 extends between the body 33 and the upper portion 107. The body 33, the wall 291 and the flow guide 47 define an annular overflow chamber 293 and such chamber 293 is isolated from the air gap 103 by the wall 291.

The eductor 10 has a collector passage 249 in the flow guide 47 which extends along and is concentric with the eductor long axis 53. At least one aperture 295 is formed in the flow guide 47 and extends between and is in flow communication with the collector passage 249 and the overflow chamber 293. Most preferably, there are first and second apertures 295, 297 in the flow guide 47 and each aperture 295, 297 radially-outwardly increases in cross-sectional area.

Under certain operating conditions, an aperture 295 or 297 permits a quantity of liquid 299, e.g., water (also referred to herein as a "first liquid"), to bypass the venturi tube 51 and flow to the outlet port 43. If the incoming water feed rate and/or the back pressure imposed on the eductor 10 by the connected tube 29 (shown in FIG. 1) or by an implement connected to such tube 29 are sufficient to prevent all incoming water from being accepted by the venturi tube 51, an aperture 295 or 297 provides a bypass path for the excess water.

Figure 35:
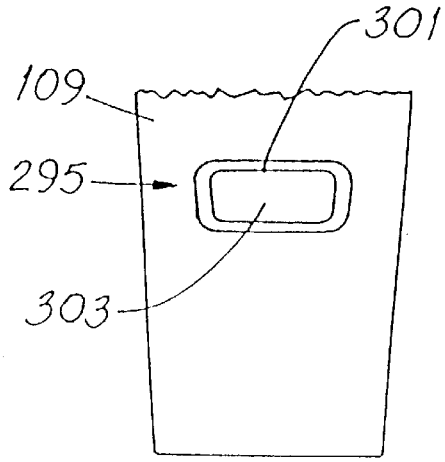
FIG. 35 is a greatly enlarged view of a portion of the upper body of FIG. 33 showing an aperture formed therein. Parts are broken away.

Referring particularly to FIGS. 33 and 35, each aperture 295, 297 is bounded by an edge 301 at the collector passage 249 and each such edge 301 defines a first area 303. At the location 305, the collector passage 249 has a minimum flow area 307 at its lower end 309 and the first area 303 is at least twice the minimum flow area 307. More preferably, such first area 303 is at least three times the minimum flow area 307. (The area 307 is coincident with the plane 311 which is normal to the axis 53.)

In an embodiment with first and second apertures 295, 297 the total of the first areas 303 is at least 1.5 times the minimum flow area 307. Most preferably, the total of the first areas 303 is in the range of 1.5 to 2.5 times the minimum flow area 307.

In a specific embodiment, the first and second apertures 295, 297 are in registry with a lateral axis 313 which is generally normal to the long axis 53. Stated another way, such apertures 295, 297 are opposite one another in the flow guide 47.

In another aspect of this embodiment of the eductor 10, the flow guide lower end 309 is spaced from the air gap 103 and has an interior dimension DI3 measured generally normally to the eductor long axis 53. Each of the apertures 295, 297 is spaced above the lower end 309 by a spacing dimension DI4 at least equal to the interior dimension DI3 and, preferably, by a spacing dimension DI4 which is between 1.0 and 6.0 times the interior dimension DI3. Most preferably, the spacing dimension DI4 is about 1.5 times the interior dimension DI3.

Referring again to FIGS. 32, 33 and 34, in yet another aspect of this embodiment, the venturi tube 51 abuts the lower end 309 of the flow guide 47. In a specific embodiment, the lower end 309 has a pocket 315 formed in it and the venturi tube 51 is in sealing engagement with the pocket 315.

The venturi tube 51 has an inlet mouth 317, the edge 131*a* of which is annular and flat in a plane generally normal to the eductor axis 53. Such edge 131*a* defines a mouth area 319 (through which liquid flows) which is at least equal to—and preferably slightly greater than—the minimum flow area 307 of the flow guide 47. When the minimum flow area 307 and the mouth area 319 are circular, such areas 307, 319 are concentric. Configured in this way, the venturi tube inlet mouth 317 is prevented from presenting an inwardly projecting lip to flowing liquid which may impede such flow.

In still another aspect of the embodiment of the eductor 10, each of the flow guide first and second portions 107 and 109, respectively, has a length L1 and L2, respectively, measured along the long axis 53. The length L2 of the second portion 109 is at least equal to the length L1 of the first portion 107. Preferably, the length L2 of the second portion 109 is between 1.0 and 4.0 times the length L1 of the first portion 107 and most preferably, the length L2 of the second portion 109 is about 2.4 times the length L1 of the first portion 107. The convergence angles of the flow guide 47 are as described above in connection with FIG. 5.

Referring now to FIGS. 1, 6, 7, 32 and 34, the eductor lower body 321 is closely similar to the arrangement of FIG. 6. That is, the venturi tube 51 is supported by and molded integrally with web-like radial panels 115, 117 having respective channels 141, 143. Each channel 141, 143, is in flow communication with the tube 51 (and, particularly, with its region 137) and with respective input ports 147, 149 to which containers 15 of concentrates or other liquids 17 are connected.

Referring to FIGS. 18 and 32, it is to be noted that when a hose 185 (with no restrictive "head") is attached to the outlet section 37, the configuration of the eductor 10 is as shown in FIG. 32. However, when the hose 185 is terminated by a spraying or foaming head, the flooding tube 259 and the device 49 are preferably omitted.

As used herein, the term "sharp edge" as applied to the apparatus 61 of FIGS. 11–15 means an edge 81 having a dimension measured normally to the axis 53 that is substantially equal to zero. The term "telescoped" (as used, for example, to describe the relationship of tube 51 and guide 47 shown in FIGS. 5, 6, 29) means that there is at least one plane, e.g., plane 287 in FIG. 29, normal to axis 53 which intersects the parts said to be in such relationship. Such term does not necessarily mean that such parts are in contact with one another.

The term "liquid" means a substance, e.g., water or a concentrate, which is free of interstices and also means a finely-divided powder which has interstices and flows freely like water.

Such terms as "upper," "lower," "below," "left" and the like are for purposes of explanation with respect to the drawings and should not be interpreted to require that the eductor 10 be mounted in vertical orientation. However, the terms "upper," "lower" and "below" relate to direction of liquid flow through the eductor 10. For example, tube portion 119 is referred to as an upper portion 119 since it is upstream of the low-pressure region 137. Similarly, member 137 is referred to as a lower member since it is downstream of support device 49. And the support device 49 is described to be below the venturi tube 51 since such device 49 is downstream of the tube 51.

Industrial Applicability

The new eductor 10 may be used for a variety of mixing applications including but not limited to applications involving single or multi-container dispensing equipment 11.

While the principles of the invention have been shown and described in connection with a few preferred embodiments, it is to be understood clearly that such embodiments are by way of example and are not limiting.

What is claimed:

1. In an eductor for mixing water and a liquid cleaning concentrate to form a mixture, the eductor including a long axis, an air gap, a water supply nozzle upstream of the air gap, a flow guide downstream of the air gap, a venturi tube for receiving the water from the flow guide, a channel lateral to the long axis for flowing the concentrate into the venturi tube and an outlet port for discharging the mixture, the improvement comprising:

an elongate guide passage in the flow guide and having upstream and downstream ends;

an annular overflow chamber isolated from the air gap by an imperforate wall; and an aperture formed solely in the flow guide below the imperforate wall and extending between the guide passage and the overflow chamber, thereby permitting a quantity of the water to bypass the venturi tube and flow only outwardly to the outlet port;

and wherein:

the venturi tube is the sole venturi tube in the eductor and includes a conduit therein, the conduit having an upstream end and an inverted-cone interior surface having a downstream end terminating above the lateral channel;

the flow guide includes a lower end contacting the venturi tube;

the guide passage and the conduit form an uninterrupted flow path therethrough;

the uninterrupted flow path extends with a continually-decreasing cross-sectional area from the upstream end of the guide passage to the downstream end of the inverted-cone interior surface;

the supply nozzle, the flow guide, the venturi tube and the outlet port are concentric with the long axis;

the outlet port forms the sole liquid flow path out of the eductor;

the flow guide and venturi tube include a pocket connection therebetween, are in sealing thread-free engagement with one another and abut at a shoulder extending radially outwardly from the long axis;

the flow guide and venturi tube form an essentially smooth, uninterrupted axial flow passage at said pocket connection, the uninterrupted axial flow passage being between the guide passage and the conduit.

2. The eductor of claim 1 wherein:

the aperture is bounded by an edge defining a first area;

the flow guide includes a collector passage having a minimum flow area; and the first area is at least twice the minimum flow area.

3. The eductor of claim 2 wherein the first area is at least three times the minimum flow area.

4. The eductor of claim 1 wherein:

the aperture is a first aperture and the eductor includes a second aperture formed in the flow guide and extending between the guide passage and the overflow chamber.

5. The eductor of claim 4 wherein:

each of the apertures has an edge and each of the edges defines a first area;

the collector passage has a minimum flow area; and the total of the first areas is at least 1.5 times the minimum flow area.

6. The eductor of claim 5 wherein the total of the first areas is in the range of 1.5 to 2.5 times the minimum flow area.

7. The eductor of claim 4 wherein:

the first and second apertures are in registry with a lateral axis generally normal to the long axis.

8. The eductor of claim 4 wherein:

the flow guide lower end is spaced from the air gap;

the lower end has an interior dimension measured generally normal to the long axis; and each of the apertures is spaced above the lower end by a spacing dimension at least equal to the interior dimension.

9. The eductor of claim 8 wherein each of the apertures is spaced above the lower end by a spacing dimension which is between 1.0 and 6.0 times the interior dimension.

10. The eductor of claim 1 wherein:

the guide passage has a minimum flow area at the lower end of the flow guide;

the venturi tube has an inlet mouth defining a mouth area; and the mouth area is at least equal to the minimum flow area.

11. The eductor of claim 10 wherein the minimum flow area and the mouth area are circular and concentric.

12. The eductor of claim 1 wherein:

the flow guide has a first portion and a second portion below the first portion;

the first portion and the second portion each have a length measured along the long axis; and the length of the second portion is at least equal to the length of the first portion.

13. The eductor of claim 12 wherein the length of the second portion is between 1.0 and 4.0 times the length of the first portion.

14. The eductor of claim 1 wherein the flow guide includes:

a first portion converging in a downstream direction at a first angle; and a second portion extending from the first portion and converging in a downstream direction at a second angle.

15. The eductor of claim 14 wherein the first angle is between about 40° and 80°.

16. The eductor of claim 15 wherein the second angle is between about 5° and 15°.

17. The eductor of claim 1 including an attachment portion for introducing the water into the eductor and a smoothing apparatus between the attachment portion and the flow guide for smoothing the flow of water therethrough, and wherein the smoothing apparatus includes:

a body fixed in the eductor; and a plurality of downwardly-converging passages formed in the body for flowing the water therethrough.

18. The eductor of claim 17 wherein the passages are in overlapping relationship, thereby forming plural upstream-pointing sharp edges.

19. The eductor of claim 18 wherein the smoothing apparatus is a primary apparatus and the eductor includes a secondary smoothing apparatus downstream of the venturi tube for enhancing laminarity.

20. The eductor of claim 1 including a plurality of channels in flow communication with the venturi tube, thereby configuring the eductor for mixing the cleaning concentrate and a third liquid with the water.

21. The eductor of claim 20 wherein:

the supply nozzle has an axial length and an opening having a diameter; and the ratio of the diameter of the supply nozzle opening to the axial length of the supply nozzle is between about 10:1 and about 21:1.

22. A method for mixing water and a liquid chemical product including providing an eductor comprising:

(a) an inlet end, (b) a backflow-preventing airgap downstream of the inlet end, (c) a flow guide in downstream relationship to the air gap and having an inlet collector passage, an exhaust end, a guide passage between the collector passage and the exhaust end, and an aperture formed solely in the flow guide between the collector passage and the exhaust end, (d) a venturi tube contacting the exhaust end, (e) a single outlet port downstream of the venturi tube, (f) a channel connecting the venturi tube to a container of the chemical product, and (g) a long axis having the inlet end, the flow guide, the venturi tube and the outlet port concentric therewith and the channel lateral thereto;

and wherein:

the venturi tube is the sole venturi tube in the eductor and includes a conduit having an upstream end and an inverted-cone interior surface having a downstream end terminating above the lateral channel;

the guide passage has upstream and downstream ends;

the guide passage and the conduit form an uninterrupted flow path therethrough, such uninterrupted flow path extending with a continually-decreasing cross-sectional area from the upstream end of the guide passage to the downstream end of the inverted-cone interior surface;

and wherein the eductor further comprises:

a pocket connection between the flow guide and venturi tube, the flow guide and venturi tube thereby being in sealing thread-free engagement with one anther and abutting an essentially smooth, uninterrupted flow passage is formed at the pocket connection by the flow guide and the venturi tube, such uninterrupted axial flow passage being between the guide passage and the conduit;

and wherein the method further include:

flowing water into the inlet end, past the air gap, through the collector passage and into the guide passage;

bypassing a first portion of the water only outwardly through the aperture into an overflow chamber which is flow-isolated from the air gap;

passing the remaining second portion of the water through the venturi tube, thereby drawing the chemical product through the channel to form a mixture of the water and the chemical product; and flowing all of the first portion of the water and all of the mixture through the single outlet port.

23. The method of claim 22 wherein the bypassing step includes bypassing at least a part of the first portion of the water against an imperforate wall, thereby preventing the first portion from reaching the air gap.

* * * * *